United States Patent [19]

Bankuty et al.

[11] Patent Number: 4,696,144

[45] Date of Patent: Sep. 29, 1987

[54] CONTAINER CAPPER AND TORQUE TESTER

[75] Inventors: Geza E. Bankuty; LeRoy F. Byron, both of Easton, Conn.

[73] Assignee: New England Machinery, Inc., New Haven, Conn.

[21] Appl. No.: 924,861

[22] Filed: Oct. 29, 1986

[51] Int. Cl.[4] ..... B67B 3/20; B65B 7/28

[52] U.S. Cl. ..... 53/331.5; 53/314; 53/317

[58] Field of Search ..... 53/317, 331:5, 314, 53/75; 279/114

[56] References Cited

U.S. PATENT DOCUMENTS

| | | | |
|---|---|---|---|
| 1,598,392 | 8/1926 | Risser | 53/331.5 |
| 3,491,516 | 1/1970 | Bergeron | 53/331.5 X |
| 3,771,284 | 11/1973 | Boeckmann et al. | 53/314 X |
| 4,222,215 | 9/1980 | Takano | 53/331.5 |
| 4,616,466 | 10/1986 | Tanaka et al. | 53/331.5 X |

FOREIGN PATENT DOCUMENTS

| | | | |
|---|---|---|---|
| 3500945 | 7/1986 | Fed. Rep. of Germany | 53/331.5 |

*Primary Examiner*—Horace M. Culver
*Attorney, Agent, or Firm*—Jack Posin

[57] ABSTRACT

A container capper is provided which includes a container clamping mechanism for clamping previously-filled containers at a capping station that is positioned at a point along a container conveying means. The capper also includes an adjustable speed rotary motor which drives a capper head having a plurality of radially movable, cap-grasper jaws supported therein for grasping caps and rotating them relative to the containers. Motor speed adjustability and torque sensing are provided to give precise control of the amount of torque with which caps are applied to containers. The capper head is vertically movable from an upper, cycle start, position to an intermediate position, at which the jaws thereof may be loaded with a cap, and to a lower position, at which the loaded cap is placed onto the top of a clamped container and is rotated thereon until a predetermined torque is reached. The capper head is moved between its upper, intermediate and lower positions by means of a camming mechanism. Caps are delivered by a second conveying mechanism from an unscrambler, or cap orienter, to a conveyor terminus adjacent to the capper head, and a transfer arm is employed to transfer the lead cap at the terminus to the intermediate position of the capper head. The cap-grasping jaws are radially moved between a cap-grasping position and a cap-releasing position by means of another camming mechanism which includes a cam plate and cam followers that are carried by and coaxial with the capper head.

25 Claims, 17 Drawing Figures

Fig. 3.
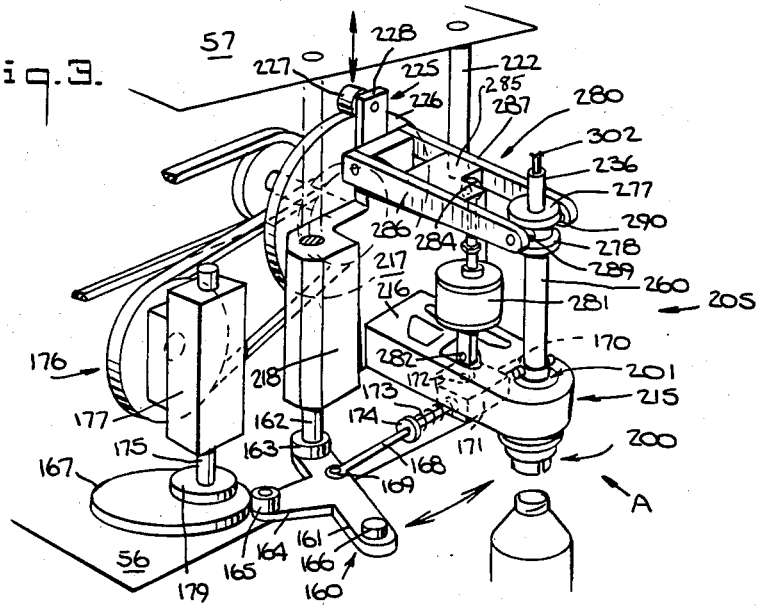
Fig. 5.
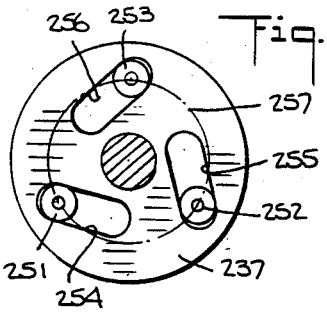
Fig. 6.
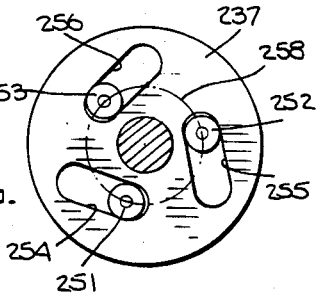
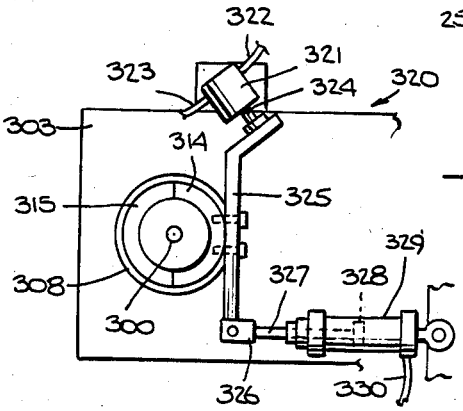
Fig. 7.

302
316
236
273
277
270
276
272
278
261
260
263
262
274
271
264
275
266
265
267
269
268
233
232
234
201
216
206
207
204
215
203
202
243
204a
230
235
238
255
252
251
237
244a
254
239
231
242
245a
241
244g
240
245g
250
250
245f
210
244c
245c
245e
244b
245b
244d
244A
245
245d
63f
105f
105g

Fig. 13.
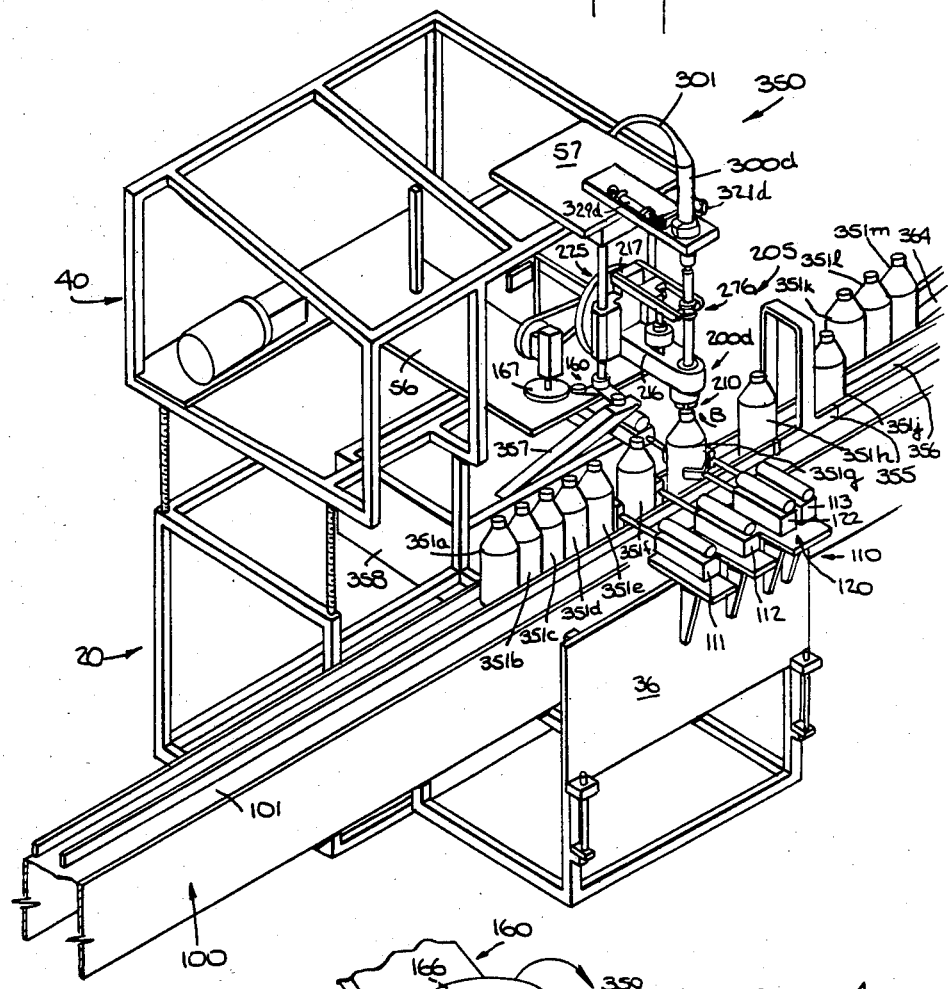
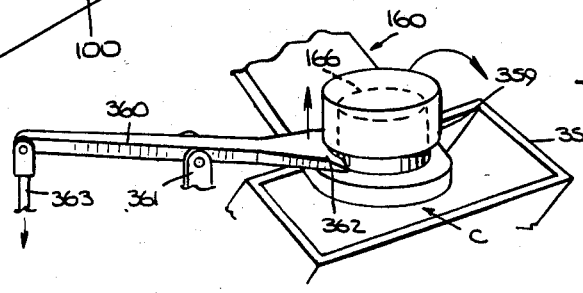
Fig. 14.

CONTAINER CAPPER AND TORQUE TESTER

BACKGROUND OF THE INVENTION

This invention relates to container cappers and, more particularly, to container cappers which utilize improved container cap grasping and rotating mechanisms and improved torque sensing and controlling devices therein. It also relates to container cap torque testers and improved apparatus for testing for and uncapping improperly capped containers.

Container cappers and torque testers are commonly used in commercial container filling lines wherein glass or plastic containers are filled with liquids or powders and then capped. The cappers are positioned downstream of the container filling apparatus and sequentially receive filled containers from that apparatus via a conveyor belt, guide ramp or the like. The cappers also sequentially receive oriented container caps from an upstream cap unscrambling device via a second conveyor belt, guide ramp or the like.

Conventionally, the capper clamps the filled containers that sequentially arrive at its work station. It also grasps individual ones of the caps that are delivered to it, places the grasped cap on the clamped container and rotates the cap to secure the cap onto the container. Then, with the container capped, the cap grasper and container clamps are released and the container is allowed to be moved away from the capper by a suitable conveying means, for example the belt which brought it to the capper.

Although the foregoing method for capping containers is quite satisfactory, the cappers that have been used in connection with this method have been a trouble spot in the container filling lines for a number of reasons, including the following. The mechanism for tightening caps onto containers has, due to a lack of adjustability in or difficulty in making adjustments to the amount of torque exerted during the cap-tightening process, resulted in leaky containers, requiring time consuming and expensive reworking and testing of contemporaneously made containers. Also, the mechanism for grasping caps has frequently damaged the caps, due to the use of excessive and/or non-uniform grasping forces therein, causing containers to have to be rejected and causing slowdowns in the filling lines. Similarly, prior cappers have generally been so arranged that when grasper jaw changes have had to be made, either due to changes in the sizes of the caps and containers that were being processed or due to damage to the jaws in use, extensive delays were encountered while the capper was disassembled sufficiently to allow the jaws to be replaced.

It is, therefore, a primary object of this invention to provide improved container cappers and torque testers.

Another object of this invention is to provide cappers and torque testers having improved mechanisms therein for adjusting the amount of torque used in tightening caps on containers.

A further object of this invention is to provide cappers and torque testers having improved cap grasping mechanisms therein.

Another object of this invention is to provide a capper in which minimum grasping pressure is uniformly applied to the jaws to center, pick up and place the cap on the container, and in which the grasping pressure increases proportionately with torque resistance to prevent slippage of the jaws relative to the caps.

Yet another object of this invention is to provide cappers and torque testers wherein the cap grasper jaws are replaceable without requiring major disassembling of the cappers and torque testers.

A still further object of the invention is to provide a capper in which torque sensing is employed to stop rotation of the capper head and to open the cap grasper jaws at the end of the capping operation.

Further objects and advantages of this invention will become apparent as the following description proceeds.

SUMMARY OF THE INVENTION

Briefly stated, and in accordance with one embodiment of this invention, there is provided an apparatus for grasping and rotating container caps, which apparatus includes a rotatable head member having movable jaw members carried thereon. Means are provided for moving the jaw members between a first position, at which the jaw members grasp a container cap with a predetermined gripping force, and a second position, at which the jaw members release the container cap. Rotary drive motor means are provided for rotating the head member, jaw members and gripped cap at a predetermined speed. Speed changing means are provided for selectively changing the rotational speed of the rotary drive motor means thereby to change the amount of torque with which the container cap is applied to a container; and, means which are coupled between the jaw members and the rotary drive motor means and which are responsive to increases of torque on the jaw members are provided for increasing the gripping force of the jaw members on the gripped cap.

Alternatively stated in somewhat greater detail, in accordance with an embodiment of this invention, there is provided a container capper which includes a container clamping mechanism for clamping previously-filled containers at a capping station that is positioned at a point along a container conveying means. The capper also includes a rotary motor driven capper head having a plurality of radially movable, cap-grasper jaws supported therein for grasping caps and rotating them relative to the containers. The capper head is vertically movable from an upper, cycle start, position to an intermediate position, at which the jaws thereof may be loaded with a cap, and to a lower position, at which the loaded cap is placed onto the top of a clamped container and is rotated thereon until a predetermined torque is reached. The capper head is moved between its upper, intermediate and lower positions by means of a camming mechanism. Caps are delivered by a second conveying mechanism from an unscrambler, or cap orienter, to a conveyor terminus adjacent to the capper head, and a transfer arm is employed to transfer the lead cap at the terminus to the intermediate position of the capper head. The cap-grasping jaws are radially moved between a cap-grasping position and a cap-releasing position by means of another camming mechanism which includes a cam plate and cam followers that are carried by and coaxial with the capper head.

BRIEF DESCRIPTION OF THE DRAWINGS

While the specification concludes with claims particularly pointing out and distinctly claiming the subject matter of this invention, it is believed that the invention will be better understood from the following description, taken in conjunction with the accompanying drawings, in which:

FIG. 3 is an enlarged perspective view of a portion of the capper of FIG. 1, showing details of the camming mechanisms employed in moving the capper head among its various positions and in moving the transfer arm between the terminus of the cap conveyor and the intermediate position of the capper head;

FIG. 5 is a plan view of a camming plate and cams used to move the jaws between their radially inner and outer positions and showing the cam followers in the positions they occupy when the jaws are in their radially outer, or open, positions;

FIG. 6 is a plan view, similar to FIG. 5, showing the cam followers in the positions they occupy when the jaws are in their radially inner, or closed, positions;

FIG. 7 is a plan view of a torque sensing mechanism utilized to stop rotation of the capper head when a cap has been sufficiently tightened onto a container;

FIG. 13 is a perspective view of a torque tester that is used to determine whether or not caps have been tightened sufficiently onto their containers;

FIG. 14 is an enlarged perspective view of a cap removing device used in the torque tester of FIG. 13 to remove from a transfer arm of the tester caps that have been unwound from their containers because they were insufficiently torqued thereon;

DESCRIPTION OF THE PREFERRED EMBODIMENTS

Figure 1:
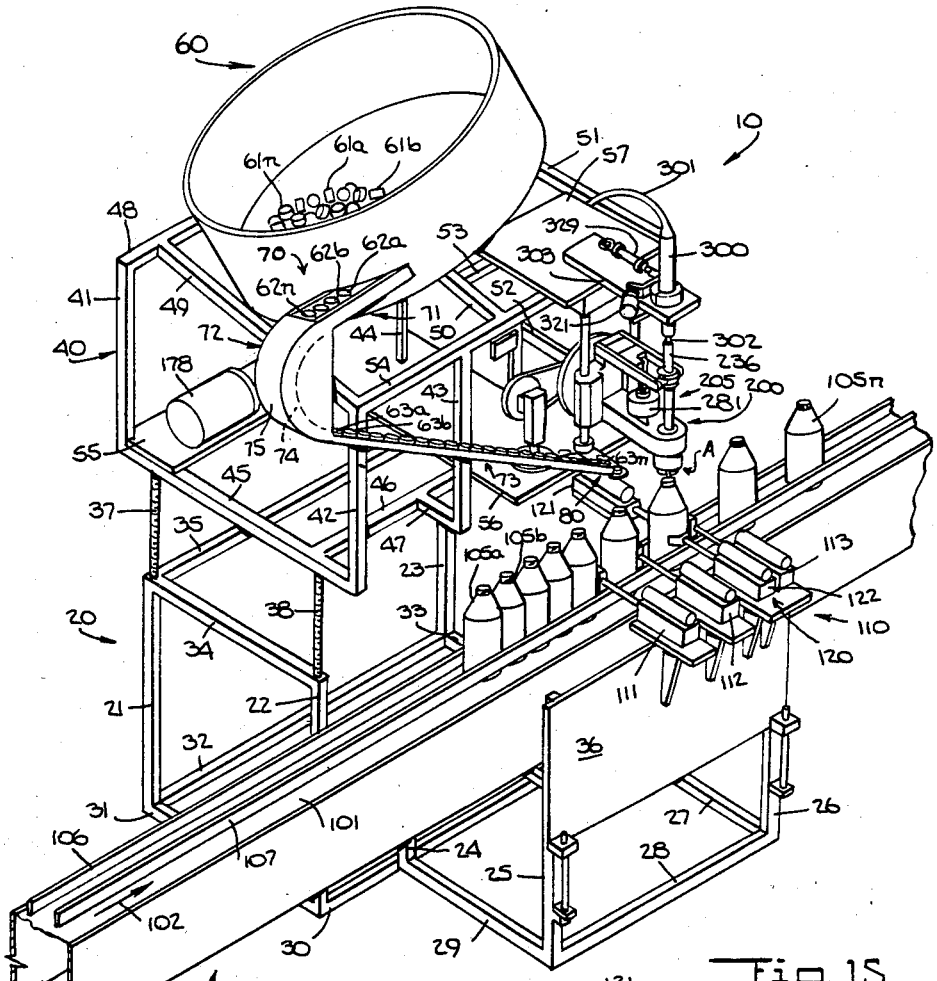
FIG. 1 is a perspective view, with parts omitted for clarity, of a capper made in accordance with one embodiment of this invention.

Referring to FIG. 1, a container capper in accordance with this invention has been shown generally at 10. The container capper 10 includes a lower frame portion, shown generally at 20, which comprises a plurality of vertical frame members or legs 21, 22, 23, 24, 25 and 26, and a plurality of horizontal frame members 27, 28, 29, 30, 31, 32, 33, 34 and 35. Lower frame portion 20 is also provided with a vertical support plate 36 fixedly carried by the vertical legs 25 and 26 and spanning the space between them.

The capper 10 also includes an upper frame portion, shown generally at 40, which is supported on lower frame portion 20 by a plurality of threaded, vertically adjustable, leg members, two of which are shown at 37 and 38. The leg members 37 and 38 are rotatably carried at the bottom of upper frame portion 40 and threadedly engage lower frame portion 20 to allow the two frame portions to be vertically adjusted relative to one another. The upper frame portion 40 comprises a plurality of vertical frame members or legs, four of which are shown at 41, 42, 43 and 44, and a plurality of horizontal frame members, including those shown at 45, 46, 47, 48, 49, 50, 51, 52, 53 and 54. Upper frame portion 40 is also provided with horizontal support plates 55, 56 and 57, which are fixedly carried by various of the horizontal frame members, including members 45, 46, 53 and 54.

A conventional container cap unscrambling device or orienter, shown generally at 60, is fixedly carried atop the upper frame portion 40. The cap orienter 60 may be similar to one of those shown, for example, in U.S. Pat. No. 2,715,978 to Walter S. Sterling, or in Canadian Patent No. 572,520 to James W. Conaway. It serves to receive therein unoriented container caps, such as those shown at 61*a*, 61*b* . . . 61*n*, and to discharge therefrom oriented container caps, such as those shown at 62*a*, 62*b* . . . 62*n*, on to a conveying device or ramp, shown generally at 70. The oriented caps 62*a*–62*n* discharged from the orienter 60 are, in the case of an orienter such as that shown in the aforementioned Conaway Canadian Patent, all discharged with their open ends up. The oriented caps 62*a*–62*n* proceed along an upstream portion 71 of the ramp 70, through a conventional cap inverter 72, from which they exit onto a downstream portion 73 of the ramp 70 with their open ends facing down, as shown at 63*a*, 63*b* . . . 63*n*.

The cap inverter 72 comprises essentially a semi-circular continuation 74 of ramp 71 which receives the caps and carries the caps during their approximately 180 degrees of movement through the inverter, at which point the caps exit from the inverter onto the downstream portion 73 of the ramp 70, with their open ends facing down. A curved cover plate 75 is provided about the curved portion 74 of the inverter 72 to prevent the caps from falling out of the inverter during their transit therethrough. After exiting the inverter, the caps proceed along the downstream portion 73 of the ramp 70 and sequentially arrive at the terminus or end of the ramp, shown generally at 80 in FIG. 1, which terminus is located adjacent to a container capping station of the apparatus, identified generally by the letter A.

Filled containers which are to be capped are sequentially delivered to the capping station A by a container delivery conveyor system, shown generally at 100, which is provided with a container indexing mechanism, shown generally at 110, that controls the movement of containers into, through and out of the capping station A. The conveyor system 100 includes a conveyor belt, the upper reach 101 of which is driven in the direction of arrow 102 by a suitable drive means (not shown). Conveyor belt reach 101 is supported between side plates 103 and 104 by suitable rollers (not shown). Filled containers 105*a*, 105*b*... 105*n* are guided in their movement on conveyor belt 101 by stationary guide rails 106 and 107, and are sequentially indexed into and out of the capping station A by indexing mechanism 110. Indexing mechanism 110 includes a set of three indexing cylinders 111, 112 and 113 in which pneumatically actuated pistons (not shown) are moved to control the indexing of the containers. The cylinders 111–113 are fixedly carried on support plate 36.

Figure 15:
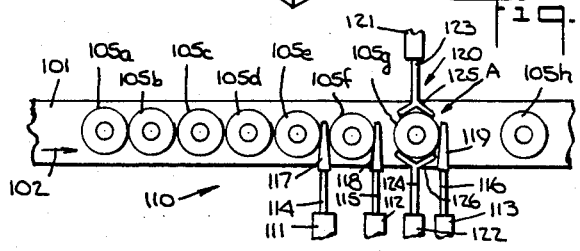
FIG. 15 is a partial plan view of the capper of FIG. 1, showing the container clamping portion thereof; and, FIGS. 16A and 16B, together, comprise a schematic view of a pneumatic system that may be utilized in controlling the various mechanisms employed in the container capper.
Figure 16A:
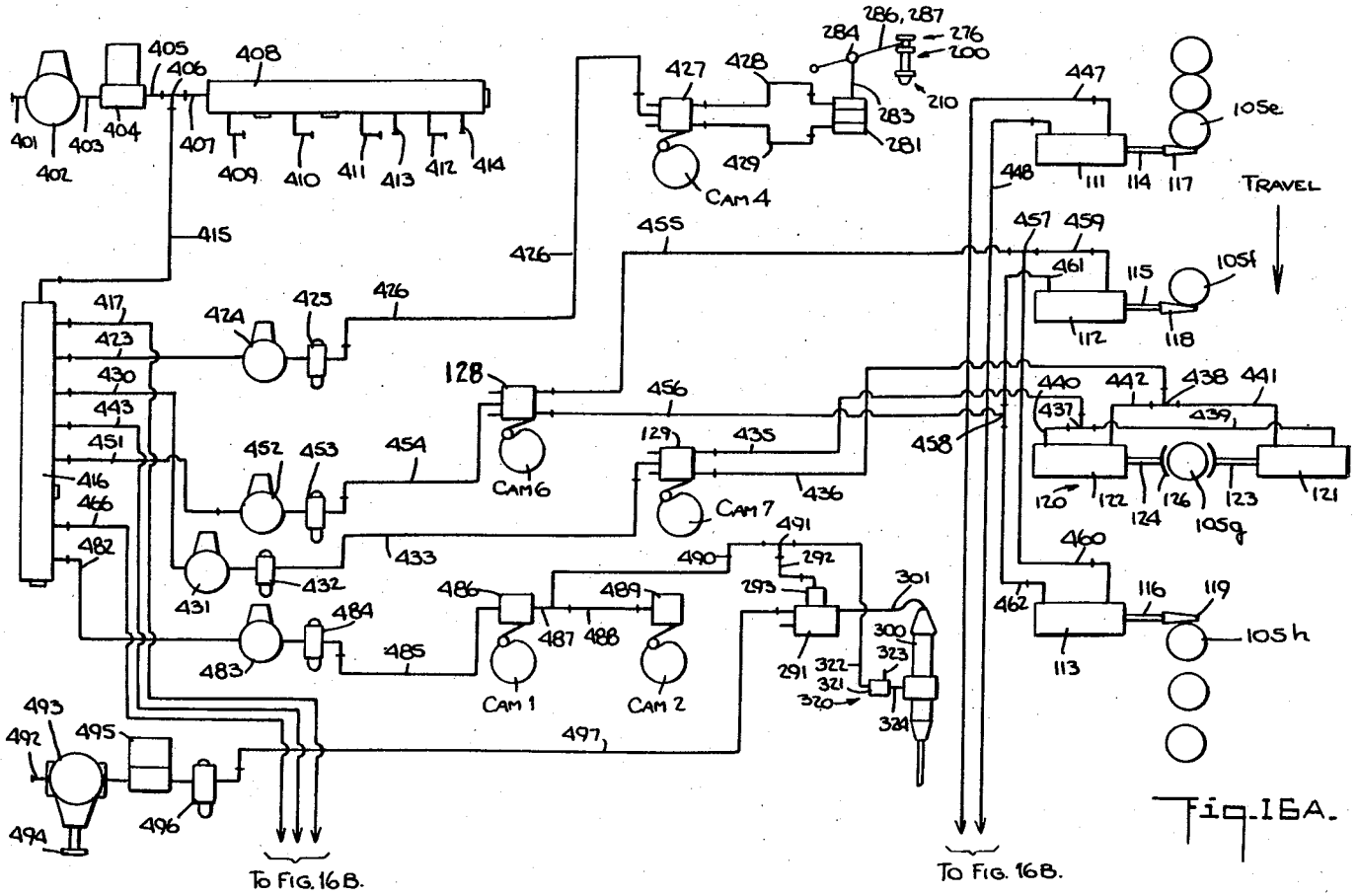
Figure 16B:
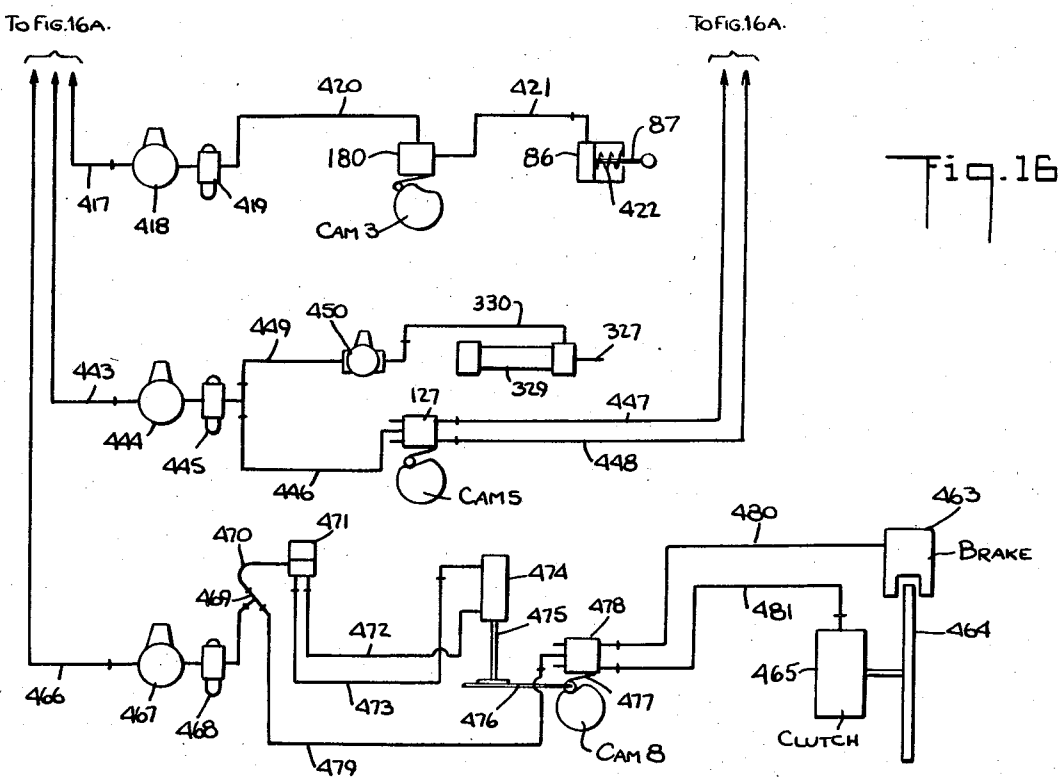

Referring to FIGS. 15, 16A and 16B in conjunction with FIG. 1, the pistons of cylinders 111–113 are provided with respective piston rods 114, 115 and 116 which, in turn, fixedly carry at their ends remote from the cylinders wedge-shaped paddles or plates 117, 118 and 119, respectively. The paddles 117–119 are shown in their extended positions in FIGS. 1, 15 and 16A, in which positions they are interposed between containers on the moving conveyor belt 101 and retain the containers upstream of their respective positions from moving downstream thereof. When one or more of the cylinders 111–113 are actuated to retract the piston rods 114–116, the corresponding paddles 117–119 are moved out of the paths of the containers on belt 101, allowing the corresponding containers to move downstream with the belt.

A clamping mechanism, shown generally at 120 and including a pair of clamping cylinders 121 and 122, is provided for clamping containers at the capping station A to prevent them from rotating when container caps are being rotated onto and torqued up on the containers. The clamping cylinders 121 and 122 contain respective pneumatically actuated pistons (not shown) therein which, in turn, move respective piston rods 123 and 124 between extended and retracted positions with respect to the cylinders. The piston rods 123 and 124 are provided at their ends remote from the pistons with respective clamping members 125 and 126 which are constructed and arranged to firmly grasp filled containers therebetween when the piston rods 123 and 124 are both extended from their corresponding cylinders. The pressure with which the containers are clamped by the clamping mechanism 120 is selected to be sufficient to hold the containers against rotation under the torques applied to the container caps but is not high enough to damage the containers.

An indexing and clamping cycle of the indexing mechanism 110 and the clamping mechanism 120 will now be described. The operating sequences of the indexing mechanism 110 and the clamping mechanism 120 are arranged so that when the container 105*g* at capping station A has been capped and is ready to be moved, clamping mechanism 120 opens (piston rods 123 and 124 retract) and piston rod 116 of indexing cylinder 113 retracts, allowing conveyor belt 101 to move container 105*g* downstream, out of capping station A to, and past, the position shown occupied by container 105*h* in FIG. 15. After container 105*g* clears paddle 119 during this movement, piston rod 116 is extended out of cylinder 113 to stop the next container at capping station A. At the same time, piston rod 115 is retracted into cylinder 112 to allow container 105*f* to to be moved by belt 101 to the capping station. When container 105*f* arrives at the capping station, clamping mechanism 120 closes to clamp the new container at that station, while piston rod 115 extends and piston rod 114 retracts to allow the next container 105*e* to be moved downstream to the position immediately upstream of the capping station A. With the closing of the clamping mechanism 120, a new container capping cycle is initiated by the capper, as will be described in greater detail hereinafter. Concurrently, when container 105*e* clears paddle 117, piston rod 114 extends to complete the indexing and clamping cycle. The movements of the various paddles and clamps described above are controlled by timer cams 5, 6 and 7 (FIGS. 16A and 16B) and respective 4-way valves 127, 128 and 129, in a manner to be described in greater detail hereinafter.

Figure 2:
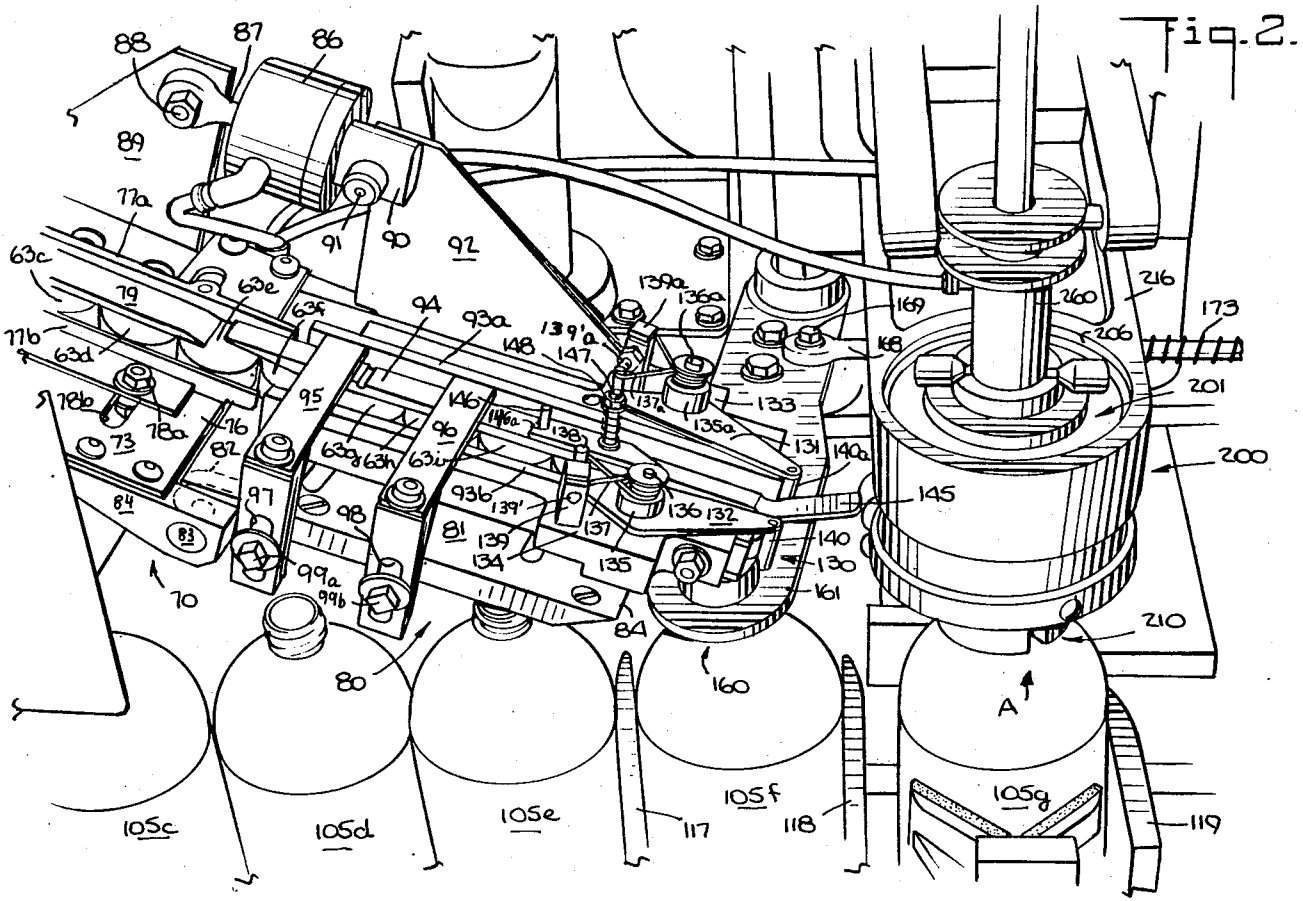
FIG. 2 is an enlarged perspective view of a portion of the capper of FIG. 1, showing details of the terminus of the cap conveyor, the cap transfer arm and the capper head.

Referring to FIG. 2 in conjunction with FIG. 1, the downstream portion 73 of cap ramp 70, and the terminus or end 80 thereof, will now be considered in greater detail. Ramp portion 73 comprises a base or slide plate 76 on which the container caps, for example caps 63*c*, 63*d* and 63*e*, slide with their open ends down, under the urging of gravity. Caps 63*c*–63*e* are guided in their movements along slide plate 76 by a pair of spaced, right-angled, side rails 77*a* and 77*b*, which rails are transversely adjustable relative to slide plate 76 by means of bolts 78*a* and slots 78*b* to allow changes in the size of caps that may be handled by the capper 10. A top guide rail 79, which is adjustably spaced from the slide plate by suitable slot and bolt means (not shown), is provided to keep the caps from being vertically squeezed out of the column of caps being guided to the ramp terminus 80.

Figure 9:
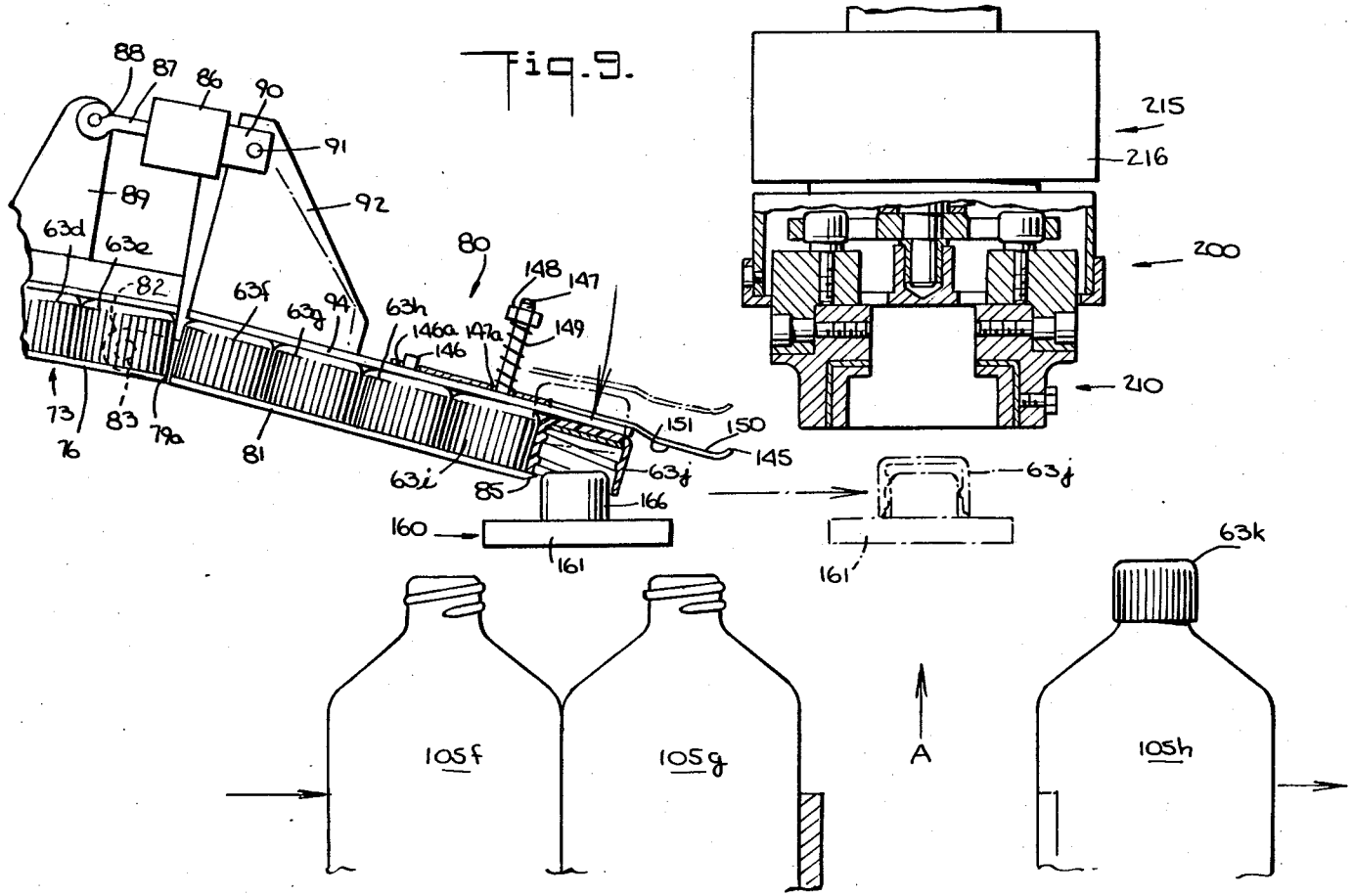
FIG. 9 is is a sectional elevation view of portions of the capper head, the terminus of the cap delivery conveyor, and the transfer arm, showing details of the manner in which caps are transferred from the conveyor to the transfer arm.
Figure 10:
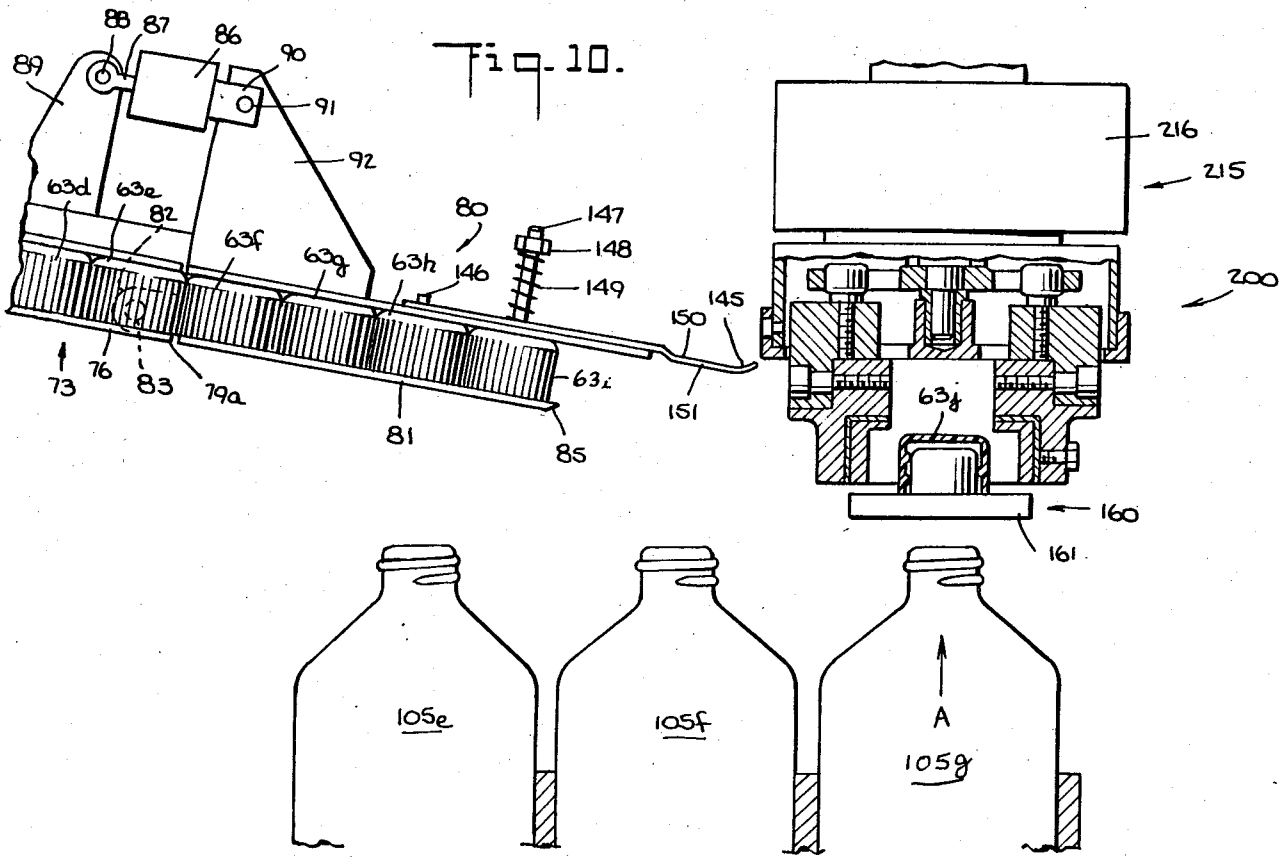
FIG. 10 is a view similar to FIG. 9, showing details of the manner in which caps on the transfer arm are positioned at the intermediate position of the capper head preparatory to being grasped by the jaws.
Figure 11:
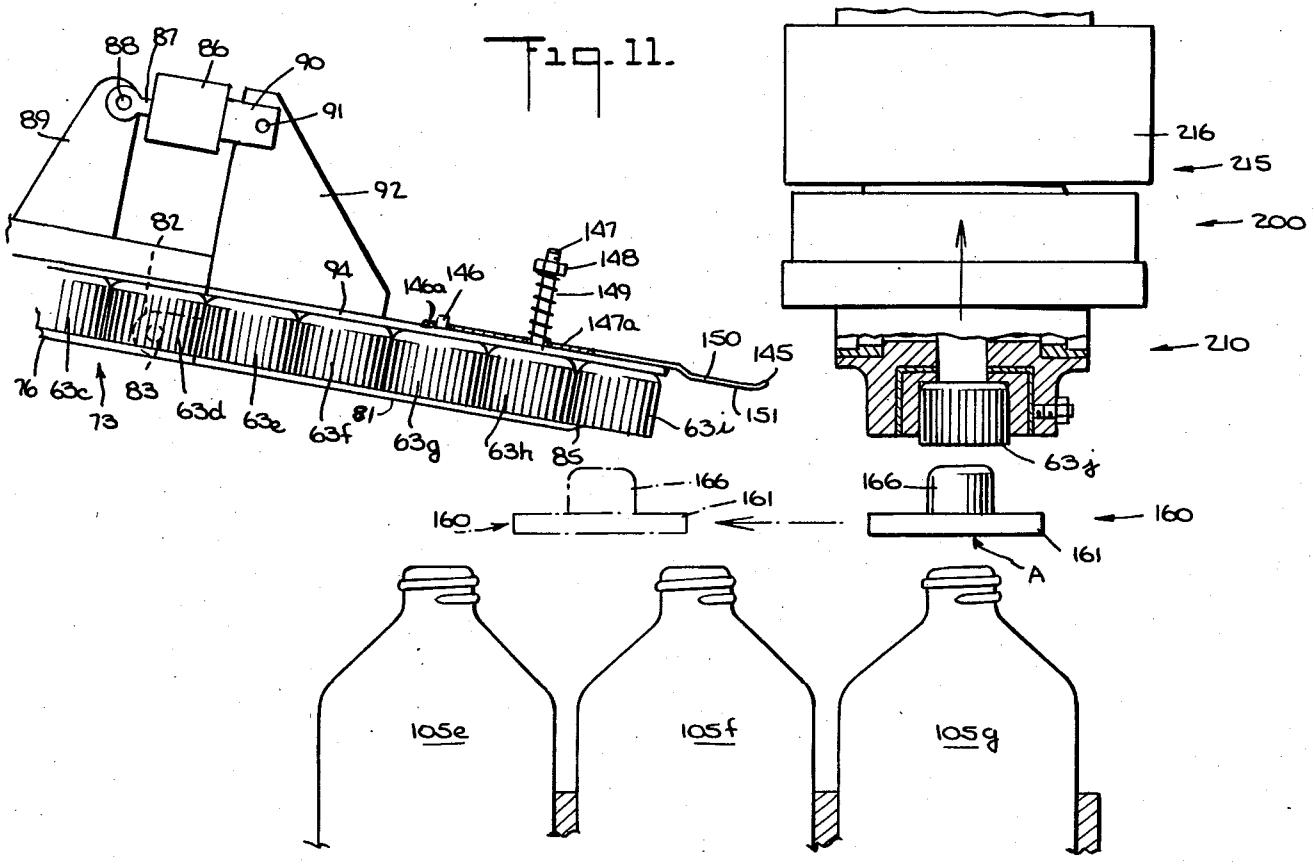
FIG. 11 is a view similar to FIGS. 9 and 10, showing details of the manner in which caps are grasped by the jaws of the capper head and removed from the transfer arm.

Referring to FIGS. 2, 9 and 10, the ramp terminus 80 will now be considered in greater detail. Terminus 80 includes a base or slide plate 81 which is provided with a pair of transversely spaced brackets, one of which is shown at 82 (FIGS. 9 and 10), that are pivotally connected at 83 to a pair of brackets, one of which is shown at 84 (FIG. 2). The brackets 84 are fixedly carried at the downstream end 79*a* of the slide plate 76. Slide plate 81 serves as a continuation of slide plate 76 and is pivotable from an upper position at which it is in the plane of slide plate 76, as shown in FIG. 10, to a lower position at which its downstream end 85 is below the plane of slide plate 76, as shown in FIG. 9.

Terminus slide plate 81 is movable between its upper and lower positions by a pneumatically actuated cylinder 86 having a piston (not shown) therein which carries a piston rod 87 at the end of which remote from cylinder 86 is pivotally connected at 88 to a vertical bracket 89 that is fixed to base plate 76 of ramp 73. The end of cylinder 86 opposite to the piston rod end thereof has an arm 90 fixed to it at one of its ends. Arm 90 is hingedly connected at the other of its ends 91 to a vertical bracket 92 that is fixed to the terminus slide plate 81. Accordingly, when piston rod 87 is extended out of cylinder 86 the terminus slide plate 81 is moved to its lower (FIG. 9) position, and when piston rod 87 is retracted into cylinder 86 the terminus slide plate 81 is moved to its upper (FIG. 10) position. This feature is used in conjunction with the transfer of caps from the terminus 80 to the capping station A, in a manner to be described in greater detail hereinafter.

Terminus slide plate 81 is provided with a pair of adjustable, transversely spaced slide rails 93*a* and 93*b* (FIG. 2), in longitudinal alignment with the side rails 77*a* and 77*b* of downstream ramp portion 73, for guiding caps 63*f*–63*i* in their movement along slide plate 81.

A top guide rail 94 is adjustably held in place above the caps 63f–63i by means of brackets 95 and 96. The brackets are provided with respective slots 97 and 98 that cooperate with bolts 99a and 99b threaded into the slide plate 81. The slot and bolt arrangement facilitates vertical adjustments of the top guide rail relative to slide plate 81 when cap size changes are to be made.

As shown most clearly in FIG. 2, the downstream end of the ramp terminus 80 is provided with a cap retaining means, shown generally at 130, which serves to prevent the lead cap 63j (FIG. 9) in the column of caps at the terminus from falling off or being pushed out from the end 85 of slide plate 81 under the gentle urging of the upstream caps yet allows that cap to be pulled from the end of the slide plate in connection with greater forces that are involved in the transfer of that cap to the capping station A, as will be described in greater detail shortly. The cap retaining means 130 includes a pair of transversely spaced, triangularly shaped, spring-biased, pivotable levers 131 and 132 carried atop enlarged portions 133 and 134 of respective side rails 93a and 93b. The levers 131 and 132 are essentially mirror images of one another and a description only of lever 132 and the parts that cooperate with it will be given, it being understood that the description also applies to lever 131 and its cooperating parts, identified by similar numerals having the subscript "a".

Lever 132 is provided with a hub 135 that is fixed to it and has a central opening which receives a post 136 that serves as a pivot for lever 132. A spring 137, which is wrapped about hub 135, has one of its ends fixed to an arm 138 carried by lever 132 and has the other of its ends anchored to a stop arm 139 fixed to side rail portion 134. Spring 137 biases the lever 132 in a counterclockwise direction about its pivot 136, as viewed in FIG. 2, causing arm 138 on its upstream end to normally come into engagement with an adjustable screw 139' on stop arm 139. Lever 131 is provided with a corresponding spring 137a that biases that lever in a clockwise direction about its corresponding pivot, causing its arm 138a at its upstream end to normally come into engagement with a corresponding stop 139'a on arm 139.

The downstream end of lever 132 has a downwardly extending pin or arm 140 fixed thereto which projects into the path of movement of the caps on slide plate 81. Arm 140, acting in conjunction with a like arm 140a carried by lever 131, blocks the downstream end of the column of caps sliding on slide plate 81, preventing the lead cap from exiting the column in the absence of sufficient force to overcome the bias of the springs 136 and 136a.

As shown in FIGS. 2 and 9, the cap retaining means 130 also includes a downwardly biased, pivotable top guide rail extension 145 which is carried atop the top guide rail 94. Extension 145 is provided with an aperture 146a that loosely fits about a pin 146 fixed to and projecting upwardly from top guide rail 94. A second aperture 147a which fits loosely about a threaded bolt 147 fixed to and projecting upwardly from top guide rail 94 is also provided in extension 145. Bolt 147 is provided with a nut 148 threaded thereon that compresses a spring 149 against the upper surface of extension 145, biasing the extension down against the upper surface of top guide rail 94 but allowing the extension to be raised as necessary during the transfer of a cap from terminus 80 to capping station A. A downstream portion 150 of top guide rail extension 145 is depressed out of the plane of the upstream portion thereof, forming a continuation 151 of the plane of the lower surface of top guide rail 94 which assists in positioning and guiding caps during their transfer to the capping station A, as described below.

Referring to FIGS. 3, 9 and 10, a cap transferring mechanism, shown generally at 160, is employed for transferring caps from the terminus 80 to the capping station A. The mechanism 160 includes a transfer arm 161 that is pivotally mounted at one of its ends with respect to a vertical rod 162 whose opposite ends are fixedly carried by the horizontal support plates 56 and 57 of the capper's upper frame 40. Upper and lower collars, the upper one of which is shown at 163, are fastened to rod 162 and utilized to vertically locate transfer arm 161 on rod 162. Transfer arm 161 is provided with a side extension 164 on which a cam follower 165 is rotatably mounted. A cap holder or protrusion 166 is removably fastened to the end of the transfer arm remote from pivot rod 162. Protrusion 166 may be changed as desired in connection with changes to be made in the type or size of caps transferred by the transfer arm.

Cam follower 165 is biased against a cam 167 by a spring loaded rod 168, one end 169 of which is pivotally attached to transfer arm 161. The other end 170 of rod 168 is slidably carried in a pivot block 171 that is pivotally supported in a clevis 172 fixed to support plate 56. A spring 173, interposed between a collar 174 fixed on rod 168 and pivot block 171, biases the transfer arm 161 and cam follower 165 toward the cam 167.

Cam 167 is keyed to a shaft 175 which is rotated by a belt and pulley drive system, shown generally at 176, and a right angle gear drive 177. A drive motor 178 (FIG. 1) is utilized to drive the belt and pulley drive system 176 through suitable shafts and gearing (not shown). Cam 167 is held in position on shaft 175 by a hub 179 (FIG. 3) that is fixed to the shaft. Cam 167 is constructed and arranged to move arm 161 rapidly between terminus 80 and capping station A but to provide dwell time at each of those locations in order to allow caps to be positioned onto a cap holder 166 at the terminus and to allow caps to be removed from the cap holder at the capping station. Cam 167 is provided with two constant but different radius portions (not shown) to provide the requisite dwell time and is provided with two varying radius portions (not shown) to move the arm between the terminus and the capping station.

Referring to FIGS. 2, 3, 8–12, 16A and 16B, the manner in which caps are transferred from terminus 80 to capping station A will now be considered in greater detail. Assuming that as a starting position transfer arm 161 is at its position under terminus 80 and that cylinder 86 has been actuated (by a timing cam 3 and a 3-way air valve 180, shown in FIG. 16B) to move the terminus to its lower position, the condition of the apparatus will be as shown in FIG. 9 in solid lines and cap 63j will be partially engaged by cap holder 166 while being retained on terminus 80 by pins 140 and 140a (FIG. 2) of spring-biased levers 132 and 131. As cam 167 rotates and cam follower 165 starts moving away from the axis of rotation of the cam, along one of the varying radius portions thereof, arm 161 starts moving to the right as viewed in FIG. 9 and cap 63j is pulled along with it. This movement of the cap forces pins 140 and 140a to spread apart, allowing cap 63j to move out of terminus 80. It also causes cap 63j to wipe against the undersurface 151 of pivotable top guide rail extension 145, causing the cap to be pushed down firmly onto the cap holder. Spring 149 allows guide rail extension 145 to pivot out of the way of the moving cap once the cap has been seated on the cap holder in order to prevent the guide rail extension from interfering with continued movement of the cap and arm toward the capping station position of the arm, shown in broken lines in FIG. 9. A capper head, shown generally at 200, which forms part of cap grasping and rotating apparatus, shown generally at 205, is in its upper, cycle start position during this movement of the transfer arm to the capping station, providing clearance for the arm to arrive at the station.

When transfer arm 161 clears the end of guide rail extension 145, cylinder 86 is actuated to raise terminus 80 to its upper position, as shown in FIG. 10. In addition, when cap 63*j* clears pins 140 and 140*a*, spring-biased levers 132 and 131 move the pins toward each other to prevent the next upstream cap, cap 63*j*, from falling or being pushed out of terminus 80. When arm 161 reaches capping station A, it starts its dwell time at this station and, concurrently, capper head 200 is moved down to its intermediate position, in a manner to be described in greater detail hereinafter, so that the cap grasper jaws thereof, shown generally at 210, are positioned about cap 63*j*, as shown in FIG. 10. Thereafter, cap grasper jaws 210 close and then capper head 200 is raised back to its upper position, in a manner to be described below, removing cap 63*j* from cap holder 166 and providing clearance for transfer arm 161 to be moved back to terminus 80. Accordingly, at this time the dwell time ends and arm 161 moves to the left, as viewed in FIG. 11, to the broken line position under the now raised terminus 80.

Upon arrival at its terminus position, arm 161 starts its dwell time at that position and, concurrently, cylinder 86 is actuated to lower terminus 80 so that the next cap on the terminus, cap 63*i*, is engaged by cap holder 166 and the transfer arm cycle is completed. During the dwell of the transfer arm at its terminus position, the capper head 200 completes its cycle of moving from its upper position (FIG. 11) through its intermediate position to its lower position (FIG. 12), placing and torqueing cap 63*j* onto container 105*g*, and releasing grasper jaws 210 and raising through its intermediate position (FIG. 8) to its upper, cycle start position, returning the apparatus to the condition shown in FIG. 9, all as will be further described hereinafter. Conventional limit switches (not shown) are employed to sense the locations of the capper head 200, the grasper jaws 210, the transfer arm 161, the slide plate 81, the various indexing paddles 117–119 (FIG. 2) and the container clamping members 125 and 126. They provide signals to conventional electrical circuits (not shown) which interrupt operation of the container capper in the event of a malfunction of the equipment. The actuation and deactuation of the various pneumatic cylinders utilized in container capper 10, including terminus cylinder 86, the container indexing cylinders 111–113 and the container clamping cylinders 121 and 122, are controlled by timing cams 1–8 (FIGS. 16A and 16B) which are ganged together and driven in timed relation with the transfer arm control cam 167 by a suitable gear and chain drive (not shown) coupled to drive motor 178 (FIG. 1).

Referring now to FIGS. 3–8 and 12, the cap grasping and rotating apparatus or mechanism 205, including capper head 200, grasper jaws 210 and their associated supporting, positioning, actuating and rotating equipment, will now be considered in greater detail. Capper head 200 is rotatably supported in a support means, shown generally at 215, by a ball thrust bearing, shown generally at 201, which comprises inner and outer races 202 and 203 having two sets of ball bearings 204 and 204*a* therebetween. Support means 215 includes a support arm 216 bracketed to a slide plate 217 having side portions 218 and 219 rigidly fixed thereto or integral therewith. Sleeve bearings 220 and 221 (FIG. 4) are fixedly carried in apertures formed in side portions 218 and 219, respectively, of the slide plate. Sleeve bearing 220 is slidably carried on rod 162, and sleeve bearing 221 is slidably carried on a rod 222, which is parallel to and spaced apart from rod 162. Rods 162 and 222 are clamped at their ends to brackets, one of which is shown at 223, that are welded or otherwise fixed to plates 56 and 57 (FIG. 3). Rods 162 and 222 constitute guides that guide slide plate 217 in its vertical movement of the the capper head 200 among the capper head's upper, intermediate and lower positions. The capper head 200 is fixed to the inner race 202 of ball thrust bearing 201, and the outer race of bearing 201 is held in place against a shoulder 230 on arm 216 by a spring clip 206 that is seated in a groove 207.

Slide plate 217 is vertically moved on guide rods 162 and 222 by a camming means, shown generally at 225, which includes a camming member or cam 226 and a cam following member or cam follower 227. Cam follower 227 is rotatably carried by an arm 228 that is adjustably bolted at 229 (FIG. 4) to slide plate 217. Cam 226 is rotated by belt and pulley drive system 176 (FIG. 3) and drive motor 178 (FIG. 1), in timed relationship with transfer arm cam 167 and the various aforementioned timing cams 1–8 (FIGS. 16A and 16B). Cam follower 227 is biased against cam 226 by the force of gravity acting upon slide plate 217 and capper head 200 mounted thereon.

Cam 226 is constructed and arranged to move capper head 200 rapidly among its various (upper, intermediate and lower) positions but to provide dwell times at each of those positions in order to allow sufficient time for the functions which are to be performed at those positions to take place. Cam 226 is provided with four constant radius portions (not shown) at three different radii to provide the requisite dwell times and is provided with four varying radius portions (not shown) to move the capper head to selected ones of its positions at predetermined times during each capping cycle.

Figure 8:
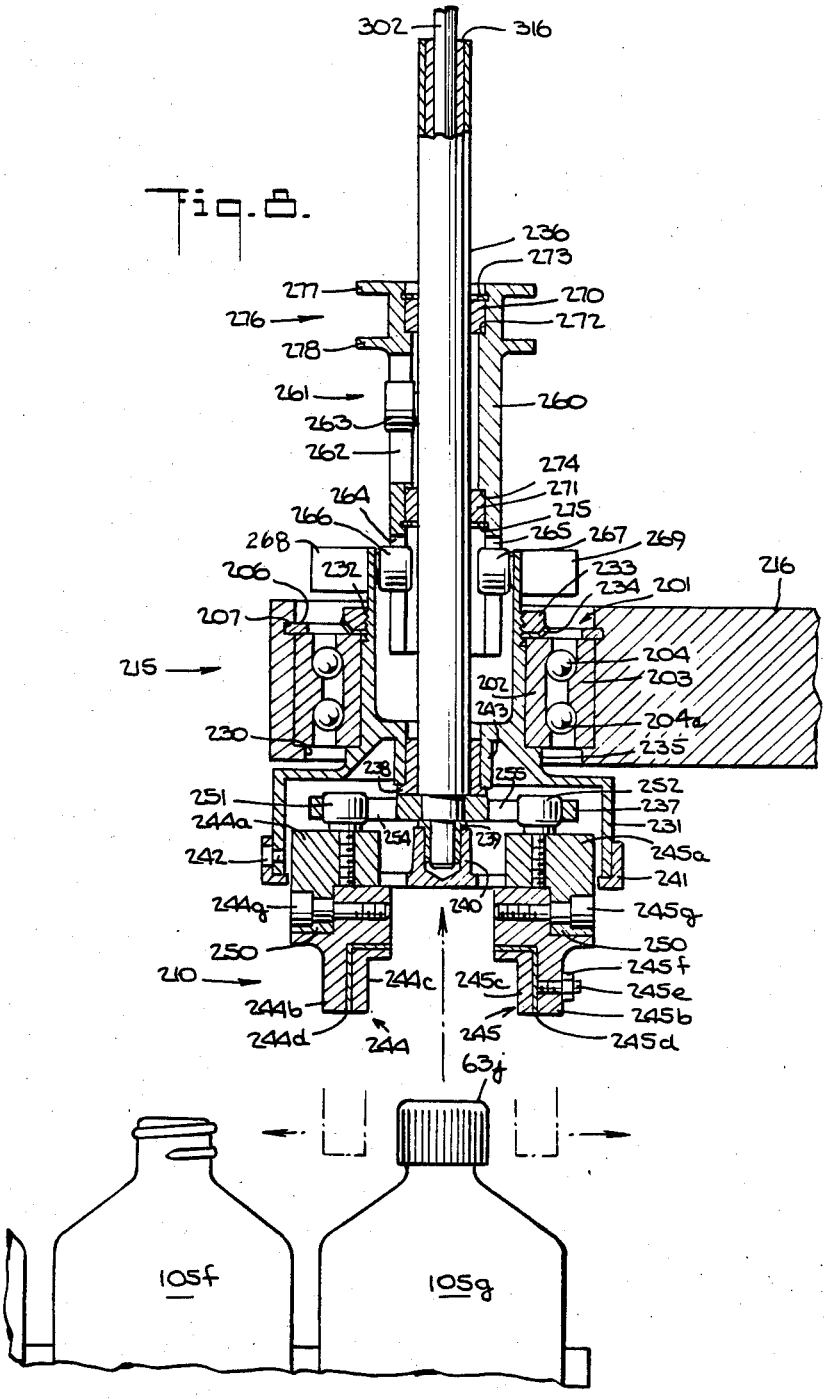
FIG. 8 is a sectional elevation view of the capper head, with parts omitted for clarity, showing details of the jaw actuating mechanism and the manner in which the capper head is rotatably supported.

Referring in particular to FIGS. 3 and 8, capper head 200 includes a housing 231 having a threaded portion 232 adjacent to its upper end on which a lock nut 233 and washer 234 are positioned. The lock nut is threaded onto threads 232 to force the lower end of the inner race 202 of bearing 201 into firm contact with a shoulder 235 formed on housing 231, locking the housing to the inner race and allowing the housing to rotate relative to support arm 216. A drive shaft 236, which has a camming member or plate 237 welded thereto adjacent its lower end and protrudes upwardly out of the upper end of housing 231, is rotatably mounted in housing 231 by means of bronze flange bearings 238 and 239. Bearing 239 is carried in a cylindrical portion 240 of an end plate or slide plate 241 that is fixed to the lower end of housing 231 by a plurality of bolts 242. Bearing 238 is carried in a cylindrical portion 243 formed on housing 231.

End plate 241 slidably supports therein the cap grasper jaws, shown generally at 210 and referred to earlier herein. The jaws 210 comprise three jaw members, shown generally at 244, 245 and 246, each of which includes an upper jaw section 244a, 245a and 246a, a lower jaw section 244b, 245b and 246b and elastomer (for example, polyurethane) lined jaw inserts, two of which are shown at 244c and 245c (FIG. 8). The jaw inserts 244c and 245c are provided with radially outer metallic support surfaces 244d and 245d to which the radially inner elastomer lining is adhered. Fastening bolts, one of which is shown at 245e, carried by the jaw inserts and cooperating with corresponding nuts, one of which is shown at 245f, are employed to fixedly position the jaw inserts on their corresponding lower jaw sections. The lower jaw sections, in turn, are bolted to the upper jaw sections by corresponding bolts, two of which are shown at 244g and 245g.

Jaw members 244, 245 and 246 are slidably mounted in respective equi-angularly spaced, radially-oriented slots 247, 248 and 249 (FIG. 4) formed in end plate 241, the upper jaw sections 244a, 245a and 246a each being provided with a downwardly projecting portion 250 which extends through a corresponding slot 247–249 to the exterior of the capper head 200. This arrangement, in addition to constraining the jaw members to radial movement relative to end plate 241, allows the lower jaw sections 244b, 245b and 246b to be changed without requiring disassembly of the capper head.

Upper jaw members 244a, 245a and 246a each carry on their upper surfaces respective upwardly projecting cam followers 251, 252 and 253 which ride in corresponding camming slots 254, 255 and 256 formed in camming plate 237. Accordingly, when relative angular rotation occurs between capper head housing 241 (which carries the jaw members 244–246 and cam followers 251–253) and drive shaft 236 (which carries camming plate 237), the jaw members 244–246 are moved radially with respect to end plate 241. Referring to FIGS. 5 and 6, the change in the radial positions of the jaw members has been schematically illustrated by the change in location of the cam followers 251–253 from a larger radius circle 257 in FIG. 5 to a smaller radius circle 258 in FIG. 6, which change accompanies a change in the relative angular positions of the camming plate 237 and the cam followers 251–253.

Referring to FIGS. 3, 4, 8 and 12, the manner in which the angular position of the capper head housing 241 is changed relative to the camming plate 237 on drive shaft 236 will now be considered. Drive shaft 236 has positioned thereon a cylindrical member 260 which is axially slidable relative to the shaft but is constrained from rotating relative to the shaft by a spline connection, shown generally at 261. The spline connection 261 comprises a slot 262 formed in cylindrical member 260, adjacent the upper end thereof, and a roller or cam follower member 263 carried by the shaft. Cynlindrical member 260 is provided adjacent its lower end with a pair of axially coextensive, circumferentially spaced, helical slots 264 and 265 of equal pitch within which ride respective cam follower members 266 and 267 that are fastened to opposite sides of the upper end of housing member 231 by nuts 268 and 269.

Cylindrical member 260 is slidably supported on drive shaft 236 by upper and lower slide bearings 270 and 271 positioned at axially spaced locations therein coaxial to both the cylindrical member and the shaft. The upper slide bearing 270 is held in place against a shoulder 272 formed on the inner surface of the cylindrical member by a snap ring 273, and the lower slide bearing 271 is held in place against a shoulder 274 therein by a snap ring 275. Cylindrical member 260 is provided adjacent its upper end with a collet, shown generally at 276, comprised of axially spaced radial flanges 277 and 278.

Figure 4:
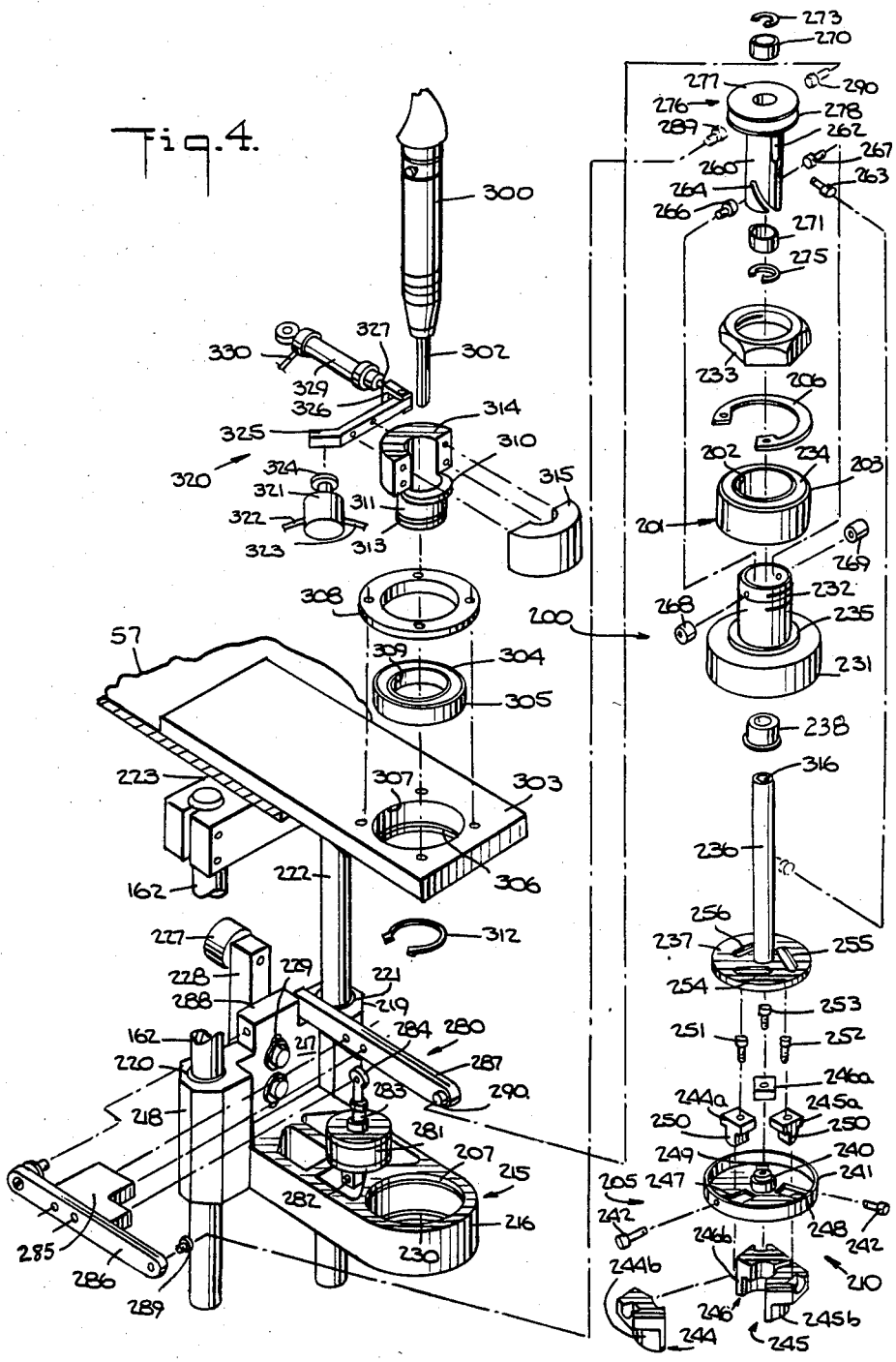
FIG. 4 is an exploded perspective view of the cap grasping and rotating apparatus of the capper, showing details of the capper head, its support assembly, a pneumatically driven motor for rotating the capper head, and an actuating mechanism for opening and closing the jaws of the capper head.

As shown most clearly in FIGS. 3 and 4, cylindrical member 260 is moved axially relative to drive shaft 236 by an actuating cylinder and linkage mechanism, shown generally at 280, that is coupled to cylindrical member 260 via collet 276. Mechanism 280 includes a pneumatically actuated cylinder 281 the lower end of which is pivotally mounted at 282 to support arm 216 of slide plate 217. A piston rod 283 projects out of the upper end of cylinder 281 and is provided with an apertured boss 284 at its upper end that is pivotally connected to a block 285. Block 285 is fastened to each of a pair of laterally spaced levers 286 and 287 which are pivotally supported at corresponding ends thereof by a protrusion 288 formed on an upper portion of slide plate 217. The opposite ends of levers 286 and 287 are provided with respective rollers 289 and 290 which are fixed thereto and extend toward one another into engagement with the flanges 277 and 288 of collet 276. The piston rod 283 is extended out of cylinder 281 when air pressure is applied to the closed end of the cylinder, and is retracted into the cylinder when air pressure is applied to the piston rod end of the cylinder.

Referring to FIGS. 3, 4, 5 and 8, when piston rod 283 is retracted into cylinder 281, levers 286 and 287 are pivoted downwardly, causing collet 276 and cylindrical member 260 to move down. The downward movement of cylindrical member 260, which is splined to shaft 236 and thus cannot rotate relative to the shaft, causes rollers 266 and 267 carried by housing 231 of capper head 200 to rotate housing 231 clockwise (as viewed in FIG. 4) relative to shaft 236. The latter movement, in turn, causes the cam followers 251–253 on jaw members 244–246 to move with respect to cam plate 237, to the positions shown in FIG. 5, at which positions the cap grasper jaws 210 are open, as shown in FIG. 8.

On the other hand, when piston rod 283 is extended out of cylinder 281, levers 286 and 287 are pivoted upwardly, causing collet 276 and cylinder 260 to move up. The upward movement of cylinder 260 causes rollers 266 and 267 carried by housing 231 to rotate the housing 231 counter-clockwise (as viewed in FIG. 4) relative to shaft 236. The latter movement, in turn, causes the cam followers 251–253 on jaw members 244–246 to move with respect to cam plate 237, to the positions shown in FIG. 6, at which positions the cap grasper jaws 210 are closed, as shown in FIG. 12.

Referring to FIGS. 1 and 4, an adjustable speed, rotary motor 300 is provided for rotating the capper head 200 and any cap that may be in the grasp of cap grasper jaws 210. Motor 300 is preferrably an air turbine driven motor, such as a "D Series" air screwdriver, made by Desoutter Incorporated, 11845 Brookfield Avenue, Livonia, Mich., but may also be an electrically or hydraulically driven motor. It is supplied with compressed air via an air line 301. The rotary output of motor 300 is supplied on a hexagonally-shaped (in cross-section) output shaft 302. Motor 300 is supported in a bracket member 303 that is welded to and extends outwardly from horizontal support plate 57 by means of a ball thrust bearing 304 (FIG. 4). The outer race 305 of bearing 304 is clamped against a shoulder 306 formed in an opening 307 in bracket 303 by means of a clamping ring 308 that is bolted to the top of bracket 303. The inner race 309 of bearing 304 supports a flange 310 on the upper end of a collar 311 that fits snugly within the inner race and is restrained from moving vertically with respect to the inner race by means of a snap ring 312 that is placed into a groove 313 of the collar and bears against the bottom surface of the inner race in the event any upwardly directed forces are generated which tend to unseat collar 311 from bearing 304.

Collar 311 is provided at its upper end with an integral clamping member 314 which cooperates with a removable clamping member 315 in clamping the collar 311 to the cylindrical mid-portion of motor 300. Accordingly, when collar 311 is clamped to motor 300 and then inserted into position in the inner race 309 of bearing 304, the lower portion of the motor and the output shaft 302 thereof extend out below bracket member 303. As also shown in FIGS. 8 and 12, this positions the lower portion of output shaft 302 telescopically within the upper end of capper head drive shaft 236. The upper end of drive shaft 236 is provided with a bushing 316 therein having a hexagonal-shaped (in cross-section) opening therein which corresponds to the hexagonal shape of the output shaft 302, thereby providing a spline connection between the two shafts.

Figure 12:
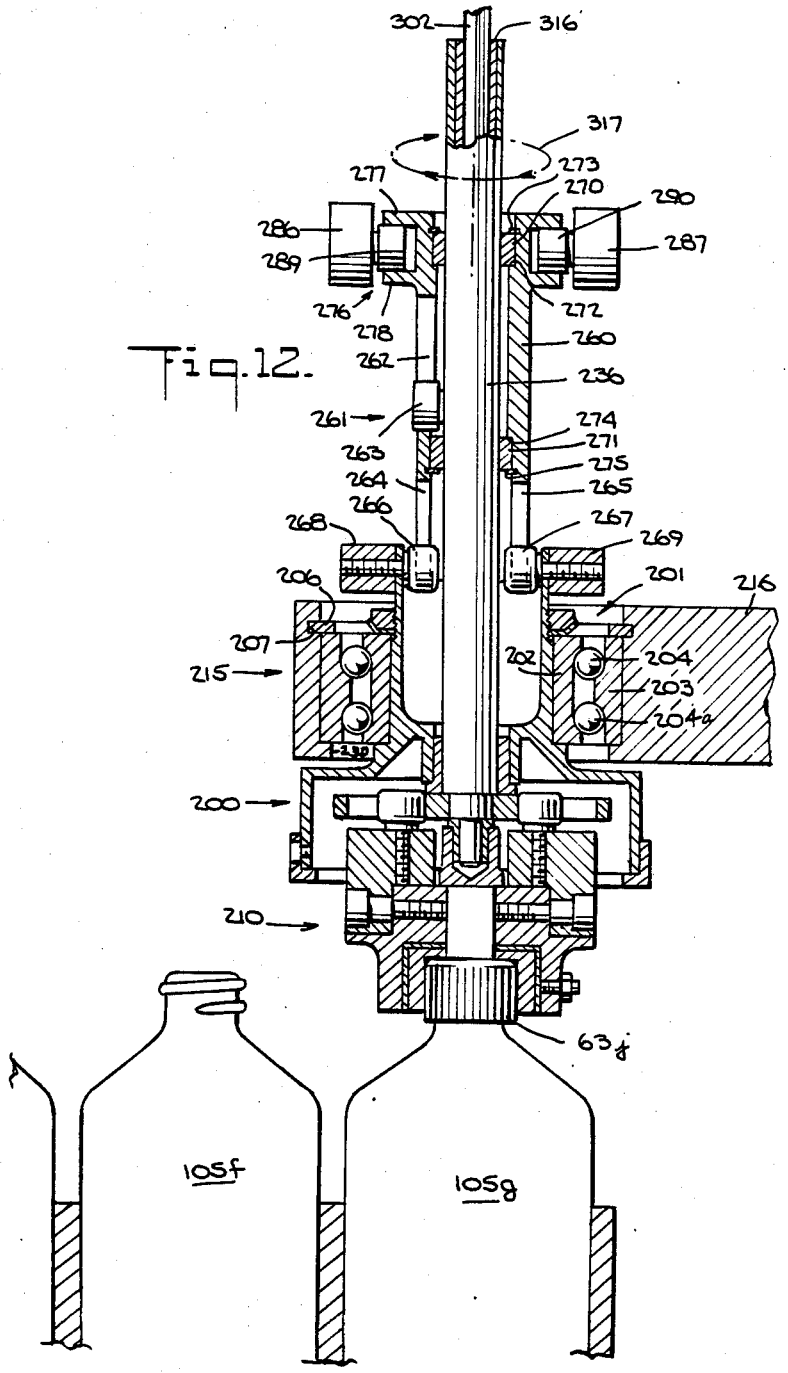
FIG. 12 is a view similar to FIG. 8, showing the capper head rotating a cap onto a container that is clamped at the capping station.

As shown in FIG. 12, the direction of rotation of output shaft 302 is as shown by arrow 317 when the cap grasping and rotating apparatus encompassed by capper head 200, cap grasper jaws 210 and rotary motor 300 are employed in a container capper 10. This has a beneficial result in that as the torque on the cap being placed on a container increases, the gripping force of the jaws on the cap increases as backlash and clearances between the various cams, cam followers and other coupled parts between cylinder 281 and jaws 210 is taken up, minimizing slippage between the cap and the jaws.

Referring to FIGS. 4, 7, 16A and 16B, a torque sensing and controlling means or device, shown generally at 320, is employed to stop the motor 300 when a cap has been rotated onto a container and has been torqued up to a predetermined amount, for example 20 to 28 inch pounds of torque. Torque sensing and controlling means 320 comprises a torque sensing air valve 321 that is adjustably fixed to bracket 303 and includes inlet and outlet air conduits 322 and 323 and a control rod 324 therein. Control rod 324 is normally biased to an extended position relative to the valve 321, at which time full air flow is directed to air motor 300 via conduit 301 (FIG. 1) from an air pilotted 2-way valve 291 (FIG. 16A) which supplies air to the air motor. A pilot bleed line 292 is connected to torque sensing air valve 321 via conduit 322. When control rod 324 is pushed into valve 321, a maintained air pilot 293 on air valve 291 is exhausted to atmosphere via conduit 323, the 2-way air valve 291 closes and the air flow to motor 300 is instantly cut off. Control rod 324 (FIG. 7) is pushed into valve 321 by one end of an arm 325 that is bolted to and rotates angularly with clamping member 314. The other end of arm 325 is pivotally connected to a clevis 326 carried at the end of a piston rod 327 that is fixed to a piston 328 (FIG. 7) movable in a cylinder 329. Cylinder 329 is hinged to bracket 303 and is provided with air under pressure via a conduit 330.

Cylinder 329 and piston 328 constitute an air spring which tends to rotate the outer casing of motor 300 clockwise, as viewed in FIG. 7, allowing the control rod 324 of valve 321 to move to its extended position at which the valve retains pilot pressure to 2-way air valve 291 which supplies full air flow to motor 300 (assuming the remaining electro-pneumatic control circuits are calling for rotation of the motor). When the motor completes the rotation of a cap onto a container and the torque on the motor starts to build up, the motor casing starts to turn counterclockwise, as viewed in FIG. 7, against the bias of the air spring cylinder 329, and arm 324 pushes control rod 324 back into air valve 321, cutting off the air flow to motor 300 in the manner described in the previous paragraph. It will thus be seen that by judiscious selection of the air pressure supplied to air spring cylinder 329, the amount of torque which motor 300 applies to caps being tightened onto containers can be precisely controlled.

Similarly, when the cap grasping and rotating apparatus of this invention is used in connection with a cap torque tester to determine whether or not caps have been applied to containers with sufficient torque, the air pressure supplied to air spring cylinder 329 can be suitably selected so that the supply of air to motor 300 is cut off at a torque level just below the level at which the caps were previously applied to the containers. For example, if the caps were previously applied with a torque level of 20 to 28 inch pounds, the pressure to cylinder 329 can be set so that air to air motor 300 is cut off when the decapping torque reaches 19 inch pounds. This would allow properly capped containers to pass through the torque tester without being decapped but would result in the decapping of containers whose caps had been insufficiently torqued up.

Referring now to FIGS. 13 and 14, a torque tester, shown generally at 350, has been illustrated. The torque tester utilizes many parts that are similar to those described in the previous discussion of container capper 10 and, therefore, such similar parts will be identified by numerals in this description of torque tester 350 that are similar to those that were used in the description of capper 10. To the extent that the parts used are exactly the same, the same numeral will be used. Where minor modifications are made to the parts, the parts will be identified by the original number followed by the letter "d" and the differences will be described.

Torque tester 350 includes a rotary motor **300*d* that is essentially similar to the capper rotary motor 300 but differs therefrom slightly in that it rotates in a counterclockwise direction, as viewed in FIG. 13, rather than in the clockwise direction of the capper motor. It also includes a torque sensing air valve 321*d* and an air spring cylinder 329*d* which are reversely mounted from the corresponding parts in capper 10 so as to be able to sense the torque on motor 300*d* notwithstanding the change in direction of rotation of the motor. Torque tester 350 further includes a decapper head 200*d* that is similar to the capper head 200 except that, referring to FIGS. 4 and 8, the helical cam slots corresponding to slots 264 and 265 are pitched in a direction opposite to that shown in FIG. 4 (i.e., they slant in a "Z" direction, rather than in an "S" direction), and the cam slots 254–256 are pitched in a direction opposite to that shown in FIG. 4 (i.e., angular rotation of the decapper head in a counter-clockwise direction relative to camming plate 237 results in an opening of the cap grasper jaws 210 of the torque tester 350, rather than a closing of the jaws as in the case of the capper 10). Accordingly, as in the case of the capper 10, as the torque on a cap that is being tested by the torque tester increases, the gripping force of the jaws 210 increases as backlash and clearances between the various cams, cam followers and other coupled parts between cylinder 281 and jaws 210** is taken up, minimizing slippage between the cap and the jaws.

As shown in FIG. 13, capped containers, such as containers 351*a*–351*e*, are delivered to the torque tester by the upper reach 101 of conveyor delivery system 100 and are indexed (see containers 351*f* and 351*g*) to a cap checking station, shown generally at B, by the container indexing mechanism 110. At cap checking station B, the clamping mechanism 120 clamps the container (container 351*g* in FIG. 13), the decapper head 200*d* is lowered to its lower position, the jaws 210 are closed and compressed air is sent to the rotary motor 300*d* until the torque on the motor reaches the predetermined setting (e.g., 19 inch pounds in the example under discussion). If the cap does not rotate off of the container under that amount of torque, the cap is sufficiently torqued up on the container and the container passes the torque test. Accordingly, the test is terminated, the clamps 120 are released and the container (for example container 351*h*) is conveyed downstream, away from cap checking station B, to and through a transversely pivotable gate 355 which, in the case of a container which passes the torque test, remains aligned with conveyor upper reach 101 to deliver the container to an output channel 356 of the tester, as illustrated in this instance by container 351*j*.

In the event the container cap is insufficiently torqued onto the container, it will be rotated off of the container and move up with the decapper head 200*d* to the upper position of the head, the head will cease rotating as a limit switch (not shown) senses the movement of the head to its upper position and signals the electro-pneumatic circuits of the apparatus to shut off the air to motor 300*d*. Next, the transfer arm 160 moves to the intermediate position of the decapper head and then the head also comes down to that position. Then jaws 210 are opened, the removed cap is deposited onto the protrusion 166 (FIG. 3) on the transfer arm and the transfer arm moves from the intermediate position of the decapper head to a cap unloading position C (FIG. 14), located above a cap discharge chute 357 the lower end of which opens into a collection box 358 for receiving removed caps.

As illustrated in FIG. 14, removed caps, such as cap 359, are unloaded from transfer arm 160 by means of a lever 360 which is pivotally carried in a clevis 361 fixed to and projecting up from plate 56. Lever 360 is provided at its end adjacent the transfer arm with a wedge-shaped concave pry or claw 362 that fits under the cap carried on the protrusion 166 of the transfer arm and partially encircles the protrusion. The opposite end of lever 360 is pivotally connected to the piston rod 363 of a penumatically operated cylinder (not shown) which, when actuated to retract the piston rod into the cylinder, causes claw 362 to raise and lift the cap 359 off of the protrusion 166, dropping it into the chute 357 for delivery to collection box 358.

Concurrently with the foregoing operation involving transfer of the removed cap from the decapper head to the collection box, the decapped container is released from the clamping means 120 at station C and indexed out of station C by index means 110 and conveyor means 100. The decapped container is then directed into gate 355 which has previously been pivotted about its upstream end in response to sensors (not shown) which determined that the container en route to the gate had been decapped. Accordingly, at this time gate 355 directs the decapped container to an alternate output channel 364 into which decapped containers, for example containers 351*k*, 351*l* and 351*m*, are routed for recycling.

Referring to FIGS. 16A and 16B, a pneumatic system that may be employed in controlling the container capper has there been schematically illustrated generally at 400. High pressure compressed air is led from a compressor source (not shown) via a conduit 401 to a regulating valve 402 which reduces the pressure thereof to about 80 psi for use in the pneumatic system 400. The compressed air is then led via a conduit 403 to a solenoid cut-off valve 404 and from there through a conduit 405 to a tee union 406. One output of the tee union 406 proceeds through conduit 407 to a manifold 408 which supplies a number air assist jets 409–412 to the unscrambler 60 (FIG. 1) for use at selected locations therein (not shown), in a known manner, in connection with the cap unscrambling operation. Manifold 408 also supplies additional air assist jets 413 and 414 which are positioned along the ramps 71 and 73 (FIG. 1), in a known manner, as selected locations therein (not shown), to assist gravity in moving caps along the ramps.

A second output of tee union 406 proceeds through conduit 415 to a second manifold 416 that, in turn, supplies various of the pneumatically operated cylinders of the capper with compressed air. Referring to FIG. 9 in conjunction with FIGS. 16A and 16B, the single acting cylinder 86 which moves slide plate 81 of terminus 80 between its upper and lower positions is supplied with compressed air from manifold 416 via a conduit 417, a regulating valve 418 which reduces the air pressure to about 60 psi, a lubricator 419, a second conduit 420, 3-way valve 180 controlled by cam 3, and a third conduit 421. When cam 3 actuates valve 180, compressed air from manifold 416 is delivered to cylinder 86, moving its piston rod out of the cylinder and lowering slide plate 81. When cam 3 deactuates valve 180, the valve cuts off the flow of compressed air to cylinder 86 and exhausts conduit 421 to atmosphere, allowing an internal spring 422 in the cylinder to raise slide plate 81 to its upper position.

Referring now to FIGS. 3 and 4 in conjunction with FIGS. 16A and 16B, the manner in which the double acting cylinder 281 opens and closes the cap grasper jaws 210 of capper head 200 will now be considered. Compressed air is led from manifold 416 through a conduit 423, a regulating valve 424, a lubricator 425, a conduit 426, a 4-way valve 427 controlled by cam 4, to one end of cylinder 281, via a conduit 428, or to the other end of the cylinder, via a conduit 429, depending on the position of cam 4. When conduit 428 is conducting compressed air to the upper end of cylinder 281, valve 427 exhausts air from the lower end of the cylinder via conduit 429 and the piston rod 283 of the cylinder is retracted into the cylinder. This results in the opening of the cap grasper jaws 210. Conversely, when cam 4 actuates valve 427 to shift position, pressurizing conduit 429 and exhausting conduit 428, the piston rod 283 is extended out of cylinder 281, causing jaws 210 to close.

The initial gripping force with which jaws 210 grasp a cap is a function of the air pressure applied to cylinder 281. This pressure is regulated by regulator 424 and is controlled by the operator by an adjustment of the setting of the regulator. The initial setting is selected to give a firm grip on the cap without crushing it. As indicated earlier herein the grip of the jaws on the cap automatically increases as the torque on the jaws increases due to the cap tightening up on the container.

At that time, the cap is almost completely wound onto the container and is supported by it in the radial direction so that the increased gripping force does not damage the cap. The increased gripping force results from a slight relative angular movement that occurs between the camming plate 237 and the cam followers 251–253 when torque starts to build up on jaws 210. It is additive to the gripping force exerted by the air pressure used to operate cylinder 281.

Referring now to FIG. 15 in conjunction with FIG. 16A, the pneumatic controls employed in operating the clamping mechanism 120 and the indexing mechanism 110 will now be considered. Compressed air is led from manifold 416 through a conduit 430, a regulating valve 431 which reduces the air pressure to about 60 psi, a lubricator 432, a conduit 433, 4-way valve 129 controlled by cam 7, one or the other of conduits 435 and 436 with the other of these conduits being exhausted to atmosphere, respective tee unions 437 and 438 and, in the case of tee union 437, to the outboard ends of cylinders 121 and 122 via respective conduits 439 and 440 and, in the case of tee union 438, to the inboard ends of cylinders 121 and 122 via respective conduits 441 and 442.

When cam 7 actuates valve 129 to concurrently pressurize conduit 435 and exhaust conduit 436, piston rods 123 and 124 extend from cylinders 121 and 122, causing the clamping members 125 and 126 to clamp container **105*g* that is located therebetween. Conversely, when cam 7 actuates valve 129 to concurrently pressurize conduit 436 and exhaust conduit 435, the clamping members 125 and 126 unclamp container 105*g***.

Compressed air is led from manifold 416 through a conduit 443, a regulating valve 444 which reduces the air pressure to about 60 psi, a lubricator 445, a conduit 446, 4-way valve 127 controlled by cam 5, one or the other of conduits 447 and 448 with the other of the these conduits being exhausted to atmosphere, to corresponding ends of cylinder 111. When conduit 448 is conducting compressed air to the closed end of cylinder 111 and conduit 447 is exhausting the rod end of the cylinder, the piston rod 114 extends out of cylinder 111, positioning paddle 117 in the path of movement of container **105*e*. Conversely, when conduit 447 is conducting compressed air to the cylinder and conduit 448 is exhausted to atmosphere, the piston rod is retracted and paddle 117 is withdrawn out of the path of movement of container 105*e***.

Conduit 443 and regulating valve 444, which supply compressed air from manifold 416 to cylinder 111 as described above, also supply compressed air to the air spring cylinder 329 of the torque sensing and control means 320 (FIG. 7). Compressed air for this purpose is led from lubricator 445 via a conduit 449 to a second regulating valve 450 in this circuit which is located at the operator's control station and is provided with a pressure gage (not shown) viewable by the operator. Conduit 330 conducts the compressed air exiting from regulating valve 450 to air spring cylinder 329. Regulating valve 450 is manually controllable by the operator and sets the air pressure to the spring at a lower level, for example 3–20 psi, than the pressures supplied to the various pneumatically actuated cylinders (normally in the range of about 60 psi). By varying the pressure to air spring cylinder 329 in the foregoing range, the point at which the air to the rotary drive motor 300 is cut off can be varied up or down, as has been mentioned earlier and will be described in greater detail below in connection with a description of the pneumatic circuits of the rotary drive motor 300.

Continuing on with the description of the compressed air circuits to the indexing means 110, compressed air is led from manifold 416 through a conduit 451, a regulating valve 452 which reduces the air pressure to about 60 psi, a lubricator 453, a conduit 454, 4-way valve 128 controlled by cam 6, one or the other of conduits 455 and 456 with the other of these conduits being exhausted to atmosphere, respective tee unions 457 and 458 and, in the case of tee union 457, to the piston rod ends of cylinders 112 and 113 via respective conduits 459 and 460 and, in the case of tee union 458, to the closed ends of cylinders 112 and 113 via respective conduits 461 and 462.

When cam 6 actuates valve 128 to concurrently pressurize conduit 455 and exhaust conduit 456, piston rods 115 and 116 retract into cylinders 112 and 113, causing the paddles 118 and 119 to release respective containers **105*f* and 105*g* for movement to their next positions in the container capper (i.e., assuming clamps 125 and 126 have previously been opened, container 105*g* moves to the position occupied by container 105*h* in FIG. 16A and container 105*f* moves to the position occupied by container 105*g* in FIG. 16A). Conversely, when cam 6 actuates valve 128 to concurrently pressurize conduit 456 and exhaust conduit 455, the paddles 118 and 119** are extended into the path of movement of containers on the conveyor belt, holding them from moving with the belt.

As shown in FIGS. 16A and 16B, the container capper includes a caliper type disk brake 463, a rotor disk 464 and a clutch 465. Rotor disk 464 is coupled to and rotates with the belt and pulley drive system 176 (FIG. 3). Clutch 465, when actuated by the application of compressed air thereto, connects rotor disk 464 to drive motor 178 (FIG. 1), causing the drive motor to rotate the belt and pulley system 176, assuming brake 463 is deactuated at that time. When clutch 465 is deactuated and brake 463 is actuated by the application of compressed air thereto, the clutch disconnects the rotor disk from the drive motor 178, and brake 463 stops the rotation of the disk 464 and the belt and pulley drive system 176 that is connected to the disk, resulting in an immediate stopping of the various mechanisms driven by the belt and pulley drive system.

The brake 463 and clutch 465 are actuated by compressed air which is led from manifold 416 through a conduit 466, a regulating valve 467 which reduces the air pressure to about 60 psi, a lubricator 468, a tee union 469, a conduit 470, and an electrically controlled solenoid valve 471 which pressurizes one or the other of conduits 472 and 473 and exhausts the other of these conduits to atmosphere depending on the state of energization or deenergization of its operating coil. Conduits 472 and 473 are connected to opposite ends of an air cylinder 474 the piston rod 475 of which carries an arm 476 that, when raised, lifts the operating lever 477 of a 4-way valve 478 out of contact with a cam 8 that normally controls valve 478. Valve 478, in turn, controls the flow of compressed air from tee union 469, via conduit 479 and conduits 480 and 481, to brake 463 and clutch 465.

Normally, when lever 477 rides on the high part of cam 8 or is raised by the arm 476 of air cylinder 474, the 4-way valve 478 directs compressed air through conduit 481, actuating clutch 465, and exhausts conduit 480, releasing brake 463. When lever 477 rides on the low part of cam 8, or is allowed to drop by the arm 476 of air cylinder 474, conduit 480 is pressurized and conduit 481 is exhausted, causing the brake to be applied and the clutch to be disengaged. Solenoid valve 471 is controllable both manually by an operator and automatically by photocells and limit switches (not shown) which may be strategically placed in the capper to sense malfunctions and stop the machine.

Considering the pneumatic controls for rotary drive motor 300 at this time, compressed air is led from manifold 416 through a conduit 482, a regulating valve 483 which reduces the air pressure to about 35 psi, a lubricator 484, a conduit 485, a 3-way valve 486 controlled by cam 1, a tee union 487, one outlet of which is connected to a conduit 488 that leads to a 2-way valve 489 controlled by cam 2 and the other outlet of which is connected to a conduit 490 that leads to another tee union 491. One outlet of tee union 491 leads to air pilot 293 of air valve 291 via conduit 292 and the other outlet of tee union 491 leads to the torque sensing air valve 321 of torque sensing and controlling means 320 via conduit 322.

Valves 486 and 489, under the control of cams 1 and 2, operate in conjunction with one another to supply compressed air to air pilot 293 and torque sensing valve 321 when valve 486 is actuated by cam 1 and valve 489 is concurrently deactuated by cam 2. Conversely, when cam 1 deactuates valve 486 and cam 2 concurrently actuates valve 489, the compressed air supply to air pilot 293 and torque sensing valve 321 is cut off by valve 486 and the conduits leading to these components are exhausted to atmosphere via valve 489. Since, as indicated earlier herein, compressed air must be supplied to air pilot 293 in order for compressed air to be supplied to rotate air motor 300, cams 1 and 2 and their associated valves serve to define the time period within which the air motor 300 may be rotated.

Compressed air for rotating air motor 300 is supplied from a source (not shown) via a conduit 492 which delivers the same to a regulating valve 493. Regulating valve 493 is used by the operator to manually adjust the speed of rotary motor 300 and, to that end, the valve is located at a control panel at the operator's station and includes a control knob 494 by which the operator can make fine adjustments to the air pressure being supplied to the motor. From regulating valve 493, the compressed air is led through an electrically-controlled cut off solenoid valve 495, which can quickly terminate air flow to the motor when desired, thriough a lubricator 496, through a conduit 497, through air-pilotted air valve 291 and through conduit 301 to air motor 300. By controlling the air pressure supplied to motor 300, the speed of the motor is precisely controlled and, with it, the torque with which container caps are tightened up onto containers. This feature provides an automatic compensation for the differences that exist from cap to cap and container to container and insures that all caps are properly torqued up onto their containers.

It will be apparent from the foregoing description that this invention provides for a variety of improved features with respect to container cappers and torque testers, and to cap grasping and rotating apparatus used therein and elsewhere. The level of torque employed in securing caps on containers is adjustable and can be conveniently reset by an operator with the turn of a knob. The grasping pressure levels automatically and proportionately increase as the torques applied to the caps are increased in order to prevent slippage of the jaws relative to the caps. Minimum levels of grasping pressure are employed in initially centering, picking up and placing caps on container. Also, the cap grasper jaws are replaceable without requiring major disassembling of the cappers and torque testers or of the cap grasping and rotating apparatus employed therein since they are accessible for replacement externally of the capper head. Moreover, torque sensing is employed to stop rotation of the capper head (or deactuate the rotary motor in the case of the torque tester) and to open the cap grasper jaws at the end of the capping (or successful torque testing) operation.

While particular embodiments of this invention have been shown and described, it will be obvious to those skilled in the art that various changes and modifications may be made without departing from this invention in its broader aspects, and it is, therefore, aimed in the appended claims to cover all such changes and modifications as fall within the true spirit and scope of this invention.

Having thus described the invention, what is claimed as new and desired to be protected by Letters Patent of the United States is:

1. Apparatus for grasping and rotating container caps, comprising a rotatable head member, jaw members movably carried by said head member and movable between a first position, at which the jaw members grasp a container cap with a predetermined gripping force, and a second position, at which the jaw members release the container cap, means for moving said jaw members between said first and second positions, means for rotating said head member at a predetermined speed, means for selectively changing the predetermined speed of rotation of said head member to thereby selectively change the torque with which the cap is tightened onto a container, and means coupled between said rotating means and said jaw members and responsive to changes in torque on said jaw members for correspondingly changing the gripping force of said jaws on said cap in response to said torque change.

2. Apparatus as described in claim 1, wherein said means for changing the gripping force of said jaws on said cap comprises a first camming member driven by said driving means and a first plurality of cam follower members carried by said jaw members, said cam follower members being angularly rotatable relative to said camming member.

3. Apparatus as described in claim 2, wherein said means for moving said jaw members comprises a second camming member and a second plurality of cam following members, one of said member or members being carried by said head member and the other of said member or members being angularly rotatable relative to said head member.

4. Apparatus as described in claim 1, wherein said head rotating means comprises a pneumatically driven motor and wherein said means for changing the speed of rotation of said head member comprises valve means positioned in an air supply conduit to said motor.

5. Apparatus as described in claim 1, and further including means for sensing the level of torque being applied to said jaw members, said means being actuated at a predetermined level of such torque to deactuate said rotating means.

6. Apparatus for grasping and rotating container caps, comprising a head member, means for supporting said head member, means for rotating said head member relative to said support means about a rotary axis of said head member, a plurality of radially movable jaw members slidably carried by said head member at one end thereof and rotatable therewith, first camming means including a first camming member positioned within said head member and rotatable therewith and first cam follower members carried by said jaw members within said head member and rotatable therewith, said cam follower members coacting with said camming member to radially move said jaw members in response to relative angular movement between said camming member and said head member, second camming means including a second camming member coaxial to and rotatable with said head member and second cam follower members carried by said head member and coacting with said second camming member, said second camming member being axially movable relative to said head member to cause changes in the relative angular relationship of said head member and said first camming member, and means for axially moving said second camming member relative to said head member thereby to radially move said jaws on said head member.

7. Apparatus as claimed in claim 6, and further including a drive shaft carried by and coaxial with said head member and axially extending from said head member at the end thereof opposite to the jaw-end thereof, said first camming member being fixed to said drive shaft, and said second camming member being carried by and splined to said drive shaft for axial movement relative thereto.

8. Apparatus as claimed in claim 7, wherein said second camming member comprises a cylindrical member positioned about said drive shaft and provided with a plurality of axially coextensive, circumferentially spaced, helical slots of equal pitch, and wherein said cam follower members comprise a corresponding number of roller members rotatably carried by said head member with said roller members being positioned within the corresponding slots of said cylindrical second camming member so that axial movement of said cylindrical camming member results in angular rotary movement of said head member and said jaw members relative to said first camming member.

9. Apparatus as described in claim 8, wherein said first camming member comprises a plate member having a plurality of spiral slots formed therein corresponding to the number of jaw members carried by said head member, and wherein said first cam follower members comprise a corresponding number of roller members rotatably carried by corresponding ones of said jaw members, said roller members being positioned within the corresponding slots of said first camming member so that angular movement of said head member relative to said first camming member causes said jaw members to move radially on said head member.

10. Apparatus as described in claim 9, wherein said head member includes an end plate having a plurality of radially extending, equi-angularly spaced, slots formed therein, there being one slot for each of said jaw members, said jaw members being movable in said slots and being constrained by said slots to radial movement relative to said head member when said head member is angularly rotated relative to said first camming member.

11. Apparatus as described in claim 10, wherein each of said jaw members comprises first and second jaw sections releasably fastened to one another, with a major portion of each first jaw section positioned within the head member and a minor portion of each first jaw section passing through a corresponding slot in the head member and projecting out of the head member, and with each second jaw section being releasably fastened to its corresponding first jaw section at a location external to said head member to permit rapid changeovers to different second jaw sections when changes are made in the size of container caps to be handled by the apparatus.

12. Apparatus as described in claim 11, wherein each of said second jaw sections is provided with a resilient, elastomer-covered radially inner surface for minimizing damage to container caps that are grasped by said jaws.

13. Apparatus as described in claim 9, wherein the spiral slots of said first camming member are constructed and arranged to cause said jaw members to be biased radially inwardly when the torque on a container cap being carried by said jaw members increases, thereby to increase the gripping pressure of said jaw members on said cap in response to such increased torque.

14. Apparatus as described in claim 13, and further including means for sensing the level of torque being applied to said container cap, said means being actuated at a predetermined level of such torque to stop said head member rotating means.

15. A container capper, including therein container cap grasping and rotating apparatus as described in claims 1, 6 or 13, wherein said cap grasping and rotating apparatus is positioned at a capping station in said container capper, said container capper further including first conveyor means for sequentially delivering to said capping station open-topped, filled containers with said open tops being positioned below said head member, second conveyor means including a transfer arm sequentially delivering to said capping station at a point intermediate said head member and said open-topped container oriented caps to be placed on said containers, and means, including a slide member slidably supporting said head member at said capping station and a slide moving means cooperable with said slide member, for moving said head member from (a) an upper position, at which it is clear of said transfer arm, to (b) an intermediate position, at which it may grasp on oriented cap, back to (c) its upper position, at which the grasped cap is clear of the transfer arm allowing movement of the latter out from under the head member, down to (d) a lower position, at which the head member rotates and torques up said cap onto the top of said filled container and then releases its grasp on said cap, and back up to (e) said upper position.

16. A container capper as described in claim 15, wherein said first conveyor means includes a container indexing mechanism for controlling the movement of containers into and out of said capping station, said indexing mechanism comprising three pneumatically controlled paddle members selectively movable transversely of said conveyor means into and out of the path of movement of corresponding containers on said conveyor means at said capping station, at a first container position immediately upstream of said capping station and at a second container position immediately upstream of said first container position, for selectively and individually transferring containers from a moving column of containers at and upstream of said second container position to an individual container at said first container position and to an individual container at said capping station.

17. A container capper as described in claim 16, and further including a pair of opposed pneumatically actuated clamping cylinders positioned at said capping station, said cylinders actuating a pair of corresponding clamping members to move transversely of said conveyor means from retracted positions, at which they are clear of the container at said capping station, to extended positions, at which they clamp the container at said capping station, preventing said container from rotating while a cap is being rotated onto and torqued up on said container.

18. A container capper as described in claim 15, wherein said second conveyor means includes a downstream slide ramp therein having a terminus pivotally connected thereto, the downstream end of which terminus is positioned adjacent to but spaced from said capping station and is movable between an upper position and a lower position, and further including means for moving said transfer arm between said lower position of said terminus and said intermediate position of said head member, cylinder means for moving said terminus between said upper position and said lower position, and spring-biased cap retaining means carried by said terminus for retaining caps at said terminus until said caps are pulled therefrom by movement of said transfer arm from said terminus to said intermediate position of said head member, said transfer arm being moved from said capping station to said lower terminus position while said terminus is in its upper position and then engaging an oriented cap at the downstream end of the terminus when the terminus is moved to its lower position.

19. A container capper as described in claim 18, wherein said terminus further includes a slide plate on which said container caps slide toward the downstream end thereof, a top guide rail adjustably positioned above and spaced from said slide plate, a pair of transversely spaced, adjustably positioned side rails carried by said slide plate, said top and side rails serving to guide said caps in their movement along said slide plate, a top guide rail extension pivotably carried by said top guide rail and extending downstream of the end of said slide plate, biasing means carried by said top guide rail and acting on said top guide rail extension to normally keep the same in the plane of the top guide rail but allowing it to pivot out of said plane during movement of said transfer arm with a cap in engagement therewith from said lower position of said terminus to said intermediate position of said head member, said top guide rail extension serving to seat said cap on said transfer arm during said movement of said transfer arm.

20. A container capper as described in claim 15, and further including means for sensing the level of torque being applied to said container cap, said means being actuated at a predetermined level of such torque to stop said head member rotating means.

21. A torque tester, including therein container cap grasping and rotating apparatus as described in claims 1, 6 or 13, wherein said cap grasping and rotating apparatus is positioned at a cap checking station in said torque tester, said torque tester further including first conveyor means for sequentially delivering capped, filled containers to said cap checking station with said capped ends of said containers being positioned below said head member, second conveyor means for removing tested, properly capped containers from said torque tester, third conveyor means for removing tested containers that were defectively capped from said torque tester, gate means positioned between the downstream end of said first conveyor means and the upstream ends of said second and third conveyor means for channeling properly capped containers to said second conveyor means and defectively capped containers to said third conveyor means, fourth conveyor means, including a transfer arm movable from a position intermediate said head member and said capped container to a cap unloading position adjacent to but clear of said cap checking station, for conveying away from said cap checking station caps which have been removed from defectively capped containers, and means, including a slide member slidably supporting said head member at said cap checking station and slide moving means cooperable with said slide member, for moving said head member from (a) an upper position, at which it is clear of capped containers arriving at said cap checking station, to (b) a lower position, at which it may grasp the cap of the capped container at the cap checking station, apply a predetermined decapping torque to said cap and rotate said cap off of said container if said predetermined torque exceeds the torque necessary to start rotating the cap off of the container, back up to (c) its upper position, at which clearance is provided for said transfer arm to be moved to said intermediate position, back down to (d) its intermediate position, at which any removed cap is placed onto the transfer arm and is released from the grasp of the head member jaws, back up to (e) its upper position, clearing the way for the transfer arm and any removed cap to be moved from said intermediate position to said cap unloading position.

22. A torque tester as described in claim 21, and further comprising cap unloading means at said cap unloading position, said cap unloading means including a pivotally mounted lever having a pry member at one end thereof engagable with the cap on said transfer arm, when actuated, to lift the cap off of said transfer arm.

23. A torque tester as described in claim 22, and further comprising chute means having an opening therein positioned below said pry member for receiving caps that have been lifted off of said transfer arm and delivering said caps to a collection point.

24. A torque tester as described in claim 23, wherein said pry member includes a marginal wedge portion thereon having a concave edge portion therein.

25. A torque tester as described in claim 24, and further including piston rod means pivotally connected to the other end of said lever for actuating said pry member into engagement with said caps on said transfer arm.

* * * * *